US007524127B2

(12) United States Patent
Petrie et al.

(10) Patent No.: US 7,524,127 B2
(45) **Date of Patent: *Apr. 28, 2009**

(54) RING BINDER MECHANISM

(75) Inventors: Aidan Petrie, Jamestown, RI (US); Daniel Nelsen, Providence, RI (US); Daniel Smith, Portsmouth, RI (US); Michael C. Pereira, Smithfield, RI (US); Kenneth Zins, Fitchburg, MA (US)

(73) Assignee: Staples The Office Superstore, LLC, Framingham, MA (US)

( * ) Notice: Subject to any disclaimer, the term of this patent is extended or adjusted under 35 U.S.C. 154(b) by 522 days.

This patent is subject to a terminal disclaimer.

(21) Appl. No.: 11/301,337

(22) Filed: Dec. 12, 2005

(65) Prior Publication Data

US 2007/0140780 A1 Jun. 21, 2007

(51) Int. Cl.

| | |
|---|---|
| ***B42F 13/06*** | (2006.01) |
| ***B42F 13/08*** | (2006.01) |
| ***B42F 3/04*** | (2006.01) |
| ***B42F 13/16*** | (2006.01) |

(52) U.S. Cl. ..... 402/19; 402/28; 402/35; 402/38

(58) Field of Classification Search ..... 402/19, 402/20, 26, 28, 30, 31, 34–39, 41, 42
See application file for complete search history.

(56) References Cited

U.S. PATENT DOCUMENTS

| | | | | |
|---|---|---|---|---|
| 778,910 | A | 1/1905 | Soennecken | |
| 842,851 | A | 2/1907 | Boden | |
| 854,074 | A | 5/1907 | Bryant | |
| 857,377 | A | 6/1907 | Baker | |
| 901,549 | A | 10/1908 | Nelson | |
| 1,228,866 | A | 6/1917 | Amoroso | |
| 1,398,388 | A | 11/1921 | Murphy | |
| 1,439,367 | A * | 12/1922 | Krag | 402/41 |
| 1,868,793 | A | 7/1932 | Dawson | |
| 1,929,614 | A | 10/1933 | Tannehill et al. | |
| 2,268,431 | A | 12/1941 | Slonneger | |
| 2,494,898 | A | 1/1950 | Rea | |
| 2,570,323 | A * | 10/1951 | Condon et al. | 402/35 |

(Continued)

FOREIGN PATENT DOCUMENTS

DE 4428112 A1 2/1996

(Continued)

OTHER PUBLICATIONS

International Search Report and Written Opinion, PCT/US2006/042658, mailed May 7, 2007.

(Continued)

*Primary Examiner*—Dana Ross
*Assistant Examiner*—Kyle Grabowski
(74) *Attorney, Agent, or Firm*—Wolf, Greenfield & Sacks, P.C.

(57) ABSTRACT

A binder mechanism includes a rotatable support having ring segments that can be locked in a closed configuration. The binder mechanism includes a horizontal and/or a flush mounted push button that opens and/or unlocks the rotatable support. The push button acts on a ramped slider that causes the rotatable support to rotate open. An over-center arrangement aids in maintaining the binder mechanism closed or opened.

19 Claims, 13 Drawing Sheets

U.S. PATENT DOCUMENTS

| | | | | |
|---|---|---|---|---|
| 2,715,906 | A | | 8/1955 | Lucchesi |
| 2,894,513 | A | | 7/1959 | Gempe et al. |
| 2,924,221 | A | | 2/1960 | Dudley-Smith |
| 3,083,713 | A | | 4/1963 | Meürer |
| 3,572,957 | A | | 3/1971 | Strassberg |
| 3,582,224 | A | | 6/1971 | Schade |
| 3,589,049 | A | | 6/1971 | Cornelius |
| 3,591,300 | A | | 7/1971 | Beyer |
| 3,595,554 | A | | 7/1971 | Donovan |
| 3,599,294 | A | | 8/1971 | Lawes |
| 3,612,709 | A | | 10/1971 | Miyamoto |
| 3,638,967 | A | | 2/1972 | Mullins |
| 3,647,306 | A | | 3/1972 | Chamberlin |
| 3,659,357 | A | | 5/1972 | Martinesco et al. |
| 3,682,433 | A | | 8/1972 | Petersen |
| 3,686,780 | A | | 8/1972 | Sheehan |
| 3,706,502 | A | | 12/1972 | La Fleur |
| 3,717,416 | A | | 2/1973 | Schade |
| 3,718,402 | A | | 2/1973 | Schade |
| 3,724,876 | A | | 4/1973 | Krikorian |
| 3,734,634 | A | | 5/1973 | Fenston |
| 3,746,457 | A | | 7/1973 | Comenitz |
| 3,748,051 | A | | 7/1973 | Frank |
| 3,763,582 | A | | 10/1973 | Stevens et al. |
| 3,766,626 | A | | 10/1973 | Mjos et al. |
| 3,771,890 | A | | 11/1973 | Notto |
| 3,776,648 | A | | 12/1973 | Price |
| 3,784,021 | A | | 1/1974 | Mark |
| 3,807,883 | A | | 4/1974 | Karlsson |
| 3,809,485 | A | | 5/1974 | Beyer |
| 3,811,212 | A | | 5/1974 | Wright |
| 3,814,527 | A | | 6/1974 | Lawes |
| 3,826,362 | A | | 7/1974 | Staskus |
| 3,826,582 | A | | 7/1974 | Podosek |
| 3,827,111 | A | | 8/1974 | O'Connell |
| 3,834,824 | A | | 9/1974 | Jahn |
| 3,837,680 | A | | 9/1974 | Cimini |
| 3,857,492 | A | | 12/1974 | Michaelis et al. |
| 3,884,586 | A | | 5/1975 | Michaelis et al. |
| 3,910,708 | A | | 10/1975 | Rohner |
| 3,913,740 | A | | 10/1975 | Bisberg |
| 3,917,067 | A | | 11/1975 | Brown et al. |
| 3,936,202 | A | | 2/1976 | Brajituli |
| 3,944,374 | A | | 3/1976 | Young et al. |
| 3,950,107 | A | | 4/1976 | Seaborn |
| 3,954,343 | A | | 5/1976 | Thomsen |
| 3,957,321 | A | | 5/1976 | Rose |
| 3,958,886 | A | | 5/1976 | Price |
| 3,982,344 | A | | 9/1976 | Phillips |
| 3,993,374 | A | | 11/1976 | Schudy et al. |
| 3,995,961 | A | | 12/1976 | Dorfman et al. |
| 4,000,951 | A | | 1/1977 | Agnew et al. |
| 4,008,305 | A | | 2/1977 | Staats |
| 4,011,018 | A | | 3/1977 | Doolittle |
| 4,019,823 | A | | 4/1977 | Kleinert et al. |
| 4,033,652 | A | | 7/1977 | O'Brien |
| 4,056,326 | A | | 11/1977 | Crawford |
| 4,060,330 | A | | 11/1977 | Baccile |
| 4,070,073 | A | | 1/1978 | Schudy et al. |
| 4,070,736 | A | | 1/1978 | Land |
| 4,129,396 | A | | 12/1978 | Stecklow |
| 4,130,368 | A | | 12/1978 | Jacoby et al. |
| 4,136,981 | A | | 1/1979 | Stecklow |
| 4,137,650 | A | | 2/1979 | Hayes |
| 4,138,143 | A | | 2/1979 | Lawes |
| 4,172,675 | A | | 10/1979 | Lacourt |
| 4,178,710 | A | | 12/1979 | Schmid |
| 4,190,374 | A | | 2/1980 | Lindell |
| 4,192,620 | A | | 3/1980 | Jahn |
| 4,200,404 | A | | 4/1980 | Agnew et al. |
| 4,201,492 | A | | 5/1980 | Almgren |
| 4,202,642 | A | | 5/1980 | Sjöstedt |
| 4,208,146 | A | | 6/1980 | Schudy |
| 4,214,839 | A | | 7/1980 | Sheehan et al. |
| 4,222,679 | A | | 9/1980 | Luogameno |
| 4,231,174 | A | | 11/1980 | Thompson |
| 4,239,411 | A | | 12/1980 | Moliard |
| 4,240,761 | A | | 12/1980 | Jacobson |
| 4,243,459 | A | | 1/1981 | Lawes |
| 4,256,411 | A | | 3/1981 | Podosek |
| 4,264,228 | A | | 4/1981 | Staats |
| 4,274,906 | A | | 6/1981 | Clar |
| 4,281,940 | A | | 8/1981 | Rhee |
| 4,295,747 | A | | 10/1981 | Errichiello |
| 4,315,696 | A | | 2/1982 | Ermanski et al. |
| 4,349,289 | A | | 9/1982 | Cardellini |
| 4,349,290 | A | | 9/1982 | Cardellini |
| 4,352,582 | A | | 10/1982 | Eliasson |
| 4,355,916 | A | | 10/1982 | Cardellini |
| 4,368,995 | A | | 1/1983 | Cohen |
| 4,373,825 | A | | 2/1983 | Zabielski |
| 4,396,209 | A | | 8/1983 | Schultz |
| 4,397,904 | A | | 8/1983 | Hulber et al. |
| 4,405,250 | A | | 9/1983 | Wu |
| 4,420,271 | A | | 12/1983 | Zabielski |
| 4,423,976 | A | | 1/1984 | Feldmahr et al. |
| 4,435,464 | A | | 3/1984 | Hulber et al. |
| 4,435,906 | A | | 3/1984 | Mori |
| 4,441,834 | A | | 4/1984 | Cardellini |
| 4,445,799 | A | | 5/1984 | Wright et al. |
| 4,482,417 | A | | 11/1984 | Hulber et al. |
| 4,483,637 | A | | 11/1984 | Updegrave et al. |
| 4,484,830 | A | | 11/1984 | Anderson |
| 4,486,112 | A | * | 12/1984 | Cummins ..... 402/34 |
| 4,518,275 | A | | 5/1985 | Rauch, III et al. |
| 4,522,526 | A | | 6/1985 | Lozfau et al. |
| 4,527,923 | A | | 7/1985 | Waldman |
| 4,531,764 | A | | 7/1985 | Chang |
| 4,544,123 | A | | 10/1985 | Peacock |
| 4,552,478 | A | | 11/1985 | Cohen |
| 4,552,479 | A | | 11/1985 | Nickow et al. |
| 4,560,299 | A | | 12/1985 | Podosek |
| 4,566,817 | A | | 1/1986 | Barrett, Jr. |
| 4,571,108 | A | | 2/1986 | Vogl |
| 4,573,821 | A | | 3/1986 | Gilreath |
| 4,573,822 | A | | 3/1986 | Allen |
| 4,576,497 | A | | 3/1986 | Beleckis |
| 4,577,985 | A | | 3/1986 | Beyer |
| 4,582,442 | A | | 4/1986 | Rager |
| 4,583,877 | A | | 4/1986 | Wilson |
| 4,588,209 | A | | 5/1986 | Zebrowski et al. |
| 4,588,321 | A | | 5/1986 | Egly |
| 4,600,346 | A | | 7/1986 | Podosek |
| 4,614,450 | A | | 9/1986 | Neiman |
| 4,639,157 | A | | 1/1987 | Herzfeld |
| 4,640,451 | A | | 2/1987 | Steiner et al. |
| 4,681,474 | A | | 7/1987 | Wiberg |
| 4,690,580 | A | | 9/1987 | Kissel |
| 4,693,625 | A | * | 9/1987 | Ohminato ..... 402/27 |
| 4,696,595 | A | | 9/1987 | Pinkney |
| 4,704,042 | A | | 11/1987 | Eisen et al. |
| 4,708,509 | A | | 11/1987 | Brunett |
| 4,710,084 | A | | 12/1987 | Ludvigsen |
| 4,722,628 | A | | 2/1988 | Rager |
| 4,729,688 | A | | 3/1988 | Manz |
| 4,733,985 | A | | 3/1988 | Moosmüller |
| 4,743,134 | A | | 5/1988 | Reinherz et al. |
| 4,749,297 | A | | 6/1988 | Roy |
| 4,750,884 | A | | 6/1988 | Bourgeois et al. |
| 4,792,253 | A | | 12/1988 | Jacobson |
| 4,795,287 | A | | 1/1989 | Friedman |
| 4,798,491 | A | | 1/1989 | Lässle |
| 4,813,803 | A | | 3/1989 | Gross |
| 4,815,882 | A | | 3/1989 | Ohminato |

4,820,071 A 4/1989 Steinfield et al.
4,852,909 A 8/1989 Stoyanoff
4,854,763 A 8/1989 Jonsson
4,872,920 A 10/1989 Flynn et al.
4,880,327 A 11/1989 Sanabria
4,886,390 A 12/1989 Silence et al.
4,896,900 A 1/1990 Hong
4,904,103 A 2/1990 Im
4,919,557 A 4/1990 Podosek
4,925,145 A 5/1990 Hegarty
4,925,328 A 5/1990 Jefferies
4,943,177 A 7/1990 Jordan et al.
4,990,017 A 2/1991 Rotherham
4,997,206 A 3/1991 Hong
4,998,840 A 3/1991 Ruble
5,028,159 A 7/1991 Amrich et al.
5,030,027 A 7/1991 Bachrach et al.
5,033,899 A 7/1991 Pitts et al.
5,035,526 A 7/1991 Cooper et al.
5,067,840 A 11/1991 Cooper et al.
5,069,568 A 12/1991 Acker
5,076,722 A 12/1991 Rohner
5,100,253 A 3/1992 Cooper
5,106,222 A 4/1992 D'Amore
5,114,259 A 5/1992 Meservy et al.
5,116,081 A 5/1992 Mann, Jr.
5,116,157 A 5/1992 Gillum et al.
5,118,213 A 6/1992 Meservy et al.
5,120,149 A 6/1992 Smith
5,135,323 A 8/1992 Pinheiro
5,154,527 A 10/1992 Blessing
5,158,386 A 10/1992 Mann, Jr.
5,160,208 A 11/1992 Lockhart
5,163,768 A 11/1992 Salisbury et al.
5,180,247 A 1/1993 Yu
5,186,565 A 2/1993 Jack
5,190,127 A 3/1993 Cummings
5,199,809 A 4/1993 Semerjian
5,213,368 A 5/1993 Wyant
5,213,429 A 5/1993 Johnson
5,219,239 A 6/1993 Bianco
5,222,690 A 6/1993 Jeffords
5,234,276 A 8/1993 Semerjian et al.
5,251,935 A 10/1993 Bottiglièri
5,255,991 A 10/1993 Sparkes
5,269,616 A 12/1993 O'Neill
D343,646 S 1/1994 Semerjian et al.
5,281,040 A 1/1994 Hodkin et al.
5,286,128 A 2/1994 Gillum
5,323,553 A 6/1994 Candido
5,332,327 A 7/1994 Gillum
5,333,962 A 8/1994 Johnson
5,340,229 A 8/1994 Schwartzman
5,348,412 A 9/1994 Fuller
5,356,155 A 10/1994 Gross
5,358,125 A 10/1994 Blessing
5,368,333 A 11/1994 Arroyo
5,368,407 A 11/1994 Law
5,378,073 A 1/1995 Law
5,379,979 A 1/1995 Due
5,393,154 A 2/1995 Hubbell
5,393,155 A 2/1995 Ng
5,394,638 A 3/1995 Raymond et al.
5,413,215 A 5/1995 Hardinger, Jr.
5,417,509 A 5/1995 Schwartz
5,423,624 A 6/1995 Richards
5,429,445 A 7/1995 Un-tae
5,430,535 A 7/1995 Acquaviva
5,441,229 A 8/1995 Spagnoli
5,441,357 A 8/1995 Wilson
5,476,335 A 12/1995 Whaley
5,490,440 A 2/1996 Karlis et al.
5,503,052 A 4/1996 Rigney et al.
5,503,489 A 4/1996 Maudal
5,503,518 A 4/1996 Scholz
5,522,508 A 6/1996 Pesola
5,577,852 A 11/1996 To
5,597,256 A 1/1997 Burton et al.
5,605,354 A 2/1997 Kwon
5,607,246 A 3/1997 Podosek
5,611,633 A 3/1997 Whaley
5,618,122 A 4/1997 Constantine
5,620,207 A 4/1997 Podosek et al.
5,620,271 A 4/1997 Bergh et al.
5,622,386 A 4/1997 Young
5,626,367 A 5/1997 Lu
5,632,113 A 5/1997 Raymond et al.
5,642,954 A 7/1997 Hudspith
5,649,799 A 7/1997 Constantine et al.
5,660,514 A 8/1997 Wilson
5,667,323 A 9/1997 Whaley
5,667,324 A 9/1997 Aoki
5,669,635 A 9/1997 Wilson et al.
5,669,689 A 9/1997 Zeifang
5,673,604 A 10/1997 Rigney
D386,786 S 11/1997 Henderson
5,683,218 A 11/1997 Mori
5,690,310 A 11/1997 Brown
5,692,848 A 12/1997 Wada
5,695,295 A 12/1997 Ayele et al.
5,697,646 A 12/1997 Venegas
5,697,722 A 12/1997 Hladik et al.
D389,183 S 1/1998 Chan
5,709,495 A 1/1998 Brunner
5,713,683 A 2/1998 Bergh et al.
5,716,153 A 2/1998 Aiello
5,718,529 A 2/1998 Chan
5,720,564 A 2/1998 Winzen
5,727,894 A 3/1998 Covey
5,755,513 A 5/1998 To
5,755,525 A 5/1998 Chan
5,772,348 A 6/1998 To
5,785,445 A 7/1998 Podosek et al.
D397,146 S 8/1998 Chan
5,788,390 A 8/1998 Law
5,788,391 A 8/1998 Cheung
5,788,392 A 8/1998 Cheung
5,806,893 A 9/1998 Wilson et al.
5,807,006 A 9/1998 Cheung
5,810,499 A 9/1998 Law
5,810,500 A 9/1998 Whaley
5,816,729 A 10/1998 Whaley
5,827,004 A 10/1998 Kim
5,836,709 A 11/1998 Cheung
5,842,807 A 12/1998 To
5,846,013 A 12/1998 To
5,857,797 A 1/1999 Streff et al.
D405,825 S 2/1999 Karten
5,864,934 A 2/1999 Young
5,868,513 A 2/1999 Law
D406,602 S 3/1999 Karten
D406,603 S 3/1999 Karten
5,876,144 A 3/1999 Bedol et al.
5,879,097 A 3/1999 Cheng
5,882,135 A 3/1999 Ko
5,888,011 A 3/1999 Reinbold, Jr.
5,891,007 A 4/1999 Bay
5,897,141 A 4/1999 Dugmore et al.
D409,385 S 5/1999 Pearson et al.
5,901,982 A 5/1999 Cooper
5,903,958 A 5/1999 Whaley
5,904,435 A 5/1999 Tung
5,911,441 A 6/1999 Yamamoto et al.
5,916,280 A 6/1999 Lantz
5,924,811 A 7/1999 To et al.
D412,530 S 8/1999 Bould 5,931,506 A 8/1999 Lo
5,938,241 A 8/1999 Wilson
D413,923 S 9/1999 Brown et al.
D413,924 S 9/1999 Bould
5,947,524 A 9/1999 Podosek
5,951,189 A 9/1999 Winzen
5,957,611 A 9/1999 Whaley
D414,801 S 10/1999 Karten et al.
5,964,544 A 10/1999 Ko
5,967,690 A 10/1999 Tibbetts
5,971,649 A 10/1999 To
5,975,784 A 11/1999 Whaley
5,975,785 A 11/1999 Chan
5,980,146 A 11/1999 To
5,988,969 A 11/1999 Maes
D417,697 S 12/1999 Long et al.
D417,890 S 12/1999 Joe et al.
6,004,060 A 12/1999 Bedol
6,007,103 A 12/1999 Tomasello
6,007,266 A 12/1999 Cheng et al.
6,010,270 A 1/2000 Friedman
6,012,866 A 1/2000 Podosek
6,024,508 A 2/2000 Lippeth et al.
6,030,139 A 2/2000 Ray
6,030,140 A 2/2000 Karten et al.
D421,460 S 3/2000 Joe et al.
6,033,144 A 3/2000 Ng et al.
6,036,394 A 3/2000 Cheng
6,039,495 A 3/2000 Zimmerman et al.
6,045,161 A 4/2000 Ashcraft et al.
6,045,286 A 4/2000 Tung
6,045,880 A 4/2000 Minichiello
6,062,760 A 5/2000 Whaley
6,074,151 A 6/2000 Pas
6,082,771 A 7/2000 Long et al.
6,086,106 A 7/2000 Joe et al.
6,086,281 A 7/2000 Covey
6,095,564 A 8/2000 Wien
6,106,018 A 8/2000 McKeown et al.
6,109,812 A 8/2000 Welch
6,109,813 A 8/2000 To et al.
6,116,804 A 9/2000 Mehta
6,126,353 A 10/2000 Mullin et al.
6,146,728 A 11/2000 Bay
D435,269 S 12/2000 Karten et al.
6,155,737 A 12/2000 Whaley
6,161,979 A 12/2000 Yamamoto et al.
D436,994 S 1/2001 Whaley
6,168,338 B1 1/2001 Young
6,168,339 B1 1/2001 To
6,168,340 B1 1/2001 Lehmann et al.
6,174,100 B1 1/2001 Song
6,179,507 B1 1/2001 Lam
6,179,508 B1 1/2001 Coerver
6,196,749 B1 3/2001 Chizmar
6,200,058 B1 3/2001 Maudal
6,203,229 B1 3/2001 Coerver
6,205,693 B1 3/2001 Pliler et al.
6,206,601 B1 3/2001 Ko
6,206,602 B1 3/2001 Yamamoto et al.
6,213,668 B1 4/2001 Brown et al.
6,213,669 B1 4/2001 Yamamoto
6,213,670 B1 4/2001 Wien
6,217,247 B1 4/2001 Ng
6,227,746 B1 5/2001 Long et al.
6,234,701 B1 5/2001 Karten et al.
6,241,414 B1 6/2001 Wien
6,250,834 B1 6/2001 Wien
6,270,279 B1 8/2001 Whaley
6,273,630 B1 8/2001 Sgro et al.
6,276,862 B1 * 8/2001 Snyder et al. ..... 402/40
6,280,114 B1 8/2001 To
6,290,421 B1 9/2001 Welch
6,293,722 B1 9/2001 Holbrook et al.
6,296,727 B1 10/2001 Chang et al.
6,302,443 B1 10/2001 Ashcraft et al.
6,305,714 B1 10/2001 Rossetto et al.
6,332,630 B1 12/2001 Wolff et al.
6,345,924 B1 2/2002 Whaley
6,357,952 B1 3/2002 McKeown
6,361,236 B1 3/2002 Podosek
6,364,558 B1 4/2002 To
6,364,559 B2 4/2002 Brown et al.
6,367,842 B1 4/2002 Wien et al.
6,368,005 B1 4/2002 Streff et al.
6,371,679 B1 4/2002 Peleman
6,379,156 B1 4/2002 Laravea et al.
6,394,684 B2 5/2002 Kapur et al.
D459,392 S 6/2002 Xu
D460,109 S 7/2002 To
6,439,093 B1 8/2002 Davies
6,453,592 B1 9/2002 Pliler et al.
6,467,984 B1 10/2002 To
6,471,438 B2 10/2002 Faris
6,474,897 B1 11/2002 To
6,488,433 B2 12/2002 Wien et al.
6,518,566 B1 2/2003 Brown
6,520,514 B2 2/2003 Clegg
6,527,465 B1 3/2003 Welch
6,533,486 B1 3/2003 To
6,550,812 B1 4/2003 Castillo et al.
6,557,897 B1 5/2003 Gaudet
6,558,064 B1 5/2003 Tibbetts
D476,682 S 7/2003 Berry et al.
D478,349 S 8/2003 Capaci
6,607,216 B1 8/2003 Stenger et al.
6,632,042 B1 10/2003 Liener Chin et al.
6,637,968 B2 10/2003 Ko
6,644,882 B2 11/2003 Brown et al.
6,652,178 B2 11/2003 Walton
6,682,247 B1 1/2004 Castillo et al.
6,702,501 B2 3/2004 Chizmar
6,746,171 B2 6/2004 Welch
6,749,061 B2 6/2004 Clausen
6,749,357 B2 6/2004 Cheng
6,758,621 B2 7/2004 To
6,761,498 B1 7/2004 Harris, Jr. et al.
6,764,242 B1 7/2004 Karten et al.
6,769,829 B1 8/2004 Castillo et al.
6,840,695 B2 * 1/2005 Horn ..... 402/31
6,843,505 B1 1/2005 Eriksen
6,845,795 B2 1/2005 Lammers et al.
RE38,731 E 5/2005 To
6,902,340 B2 6/2005 Harris, Jr. et al.
6,908,248 B2 6/2005 Pangburn
6,916,134 B2 7/2005 Wong
2001/0009631 A1 7/2001 Brown et al.
2002/0044819 A1 4/2002 Shamoon
2002/0051674 A1 5/2002 To
2002/0076262 A1 6/2002 To
2002/0085876 A1 7/2002 Ko
2002/0094226 A1 7/2002 Sapienza et al.
2002/0098031 A1 7/2002 Brown et al.
2002/0102125 A1 8/2002 Sapienza et al.
2002/0131810 A1 9/2002 Whaley et al.
2002/0146275 A1 10/2002 Gerriet
2002/0159816 A1 10/2002 Gagnon et al.
2002/0168250 A1 11/2002 Welch
2003/0035681 A1 2/2003 Ho
2003/0035932 A1 2/2003 Yamamoto et al.
2003/0044222 A1 3/2003 Dahlke et al.
2003/0053849 A1 3/2003 To et al.
2003/0073066 A1 4/2003 Warden
2003/0103796 A1 6/2003 To et al.
2003/0103798 A1 6/2003 Cheng et al.
2003/0113156 A1 6/2003 To

| | | | | |
|---|---|---|---|---|
| 2003/0122366 | A1 | 7/2003 | Sapienza et al. | |
| 2003/0155761 | A1 | 8/2003 | Stenger et al. | |
| 2003/0157472 | A1 | 8/2003 | Castillo et al. | |
| 2003/0165644 | A1 | 9/2003 | Meade et al. | |
| 2003/0198504 | A1 | 10/2003 | Hyman | |
| 2003/0213886 | A1 | 11/2003 | Gilbert | |
| 2004/0013463 | A1 | 1/2004 | To | |
| 2004/0013464 | A1 | 1/2004 | Cheng | |
| 2004/0018040 | A1 | 1/2004 | Ng et al. | |
| 2004/0042844 | A1 | 3/2004 | Ettro et al. | |
| 2004/0066031 | A1 | 4/2004 | Wong et al. | |
| 2004/0067094 | A1 | 4/2004 | Ko | |
| 2004/0113036 | A1 | 6/2004 | Gilbert | |
| 2004/0151531 | A1 | 8/2004 | Corr et al. | |
| 2004/0164543 | A1 | 8/2004 | Yamamoto et al. | |
| 2004/0170468 | A1 | 9/2004 | Chizmar | |
| 2004/0197131 | A1 | 10/2004 | Harris, Jr. et al. | |
| 2004/0197758 | A1 | 10/2004 | Langford | |
| 2004/0208685 | A1 | 10/2004 | Peters, Jr. | |
| 2005/0013653 | A1 | 1/2005 | Chin | |
| 2005/0025563 | A1 | 2/2005 | Sato et al. | |
| 2005/0058502 | A1 | 3/2005 | Ben-Or | |
| 2005/0097732 | A1 | 5/2005 | Sato et al. | |
| 2005/0105958 | A1 | 5/2005 | Kaneda | |
| 2005/0117964 | A1 | 6/2005 | Johnson et al. | |
| 2005/0160642 | A1 | 7/2005 | Schwartz | |
| 2005/0163557 | A1 | 7/2005 | England | |
| 2006/0056906 | A1 * | 3/2006 | Horn | 402/31 |
| 2006/0228164 | A1 * | 10/2006 | Horn | 402/31 |
| 2006/0251467 | A1 | 11/2006 | Cheng | |
| 2007/0086836 | A1 * | 4/2007 | Cheng | 402/37 |
| 2007/0134054 | A1 * | 6/2007 | Li | 402/36 |

FOREIGN PATENT DOCUMENTS

| | | |
|---|---|---|
| DE | 29720425 | 1/1998 |
| FR | 2 524 377 | 10/1983 |
| FR | 2 816 882 | 5/2002 |
| GB | 1 160 975 | 8/1969 |
| WO | WO 8 002 259 A | 10/1980 |

OTHER PUBLICATIONS

International Search Report from corresponding International Application No. PCT/US2007/000249, filed May 1, 2007.

International Search Report and Written Opinion from co-pending application Serial No. PCT/US2006/042657 mailed Jul. 20, 2007.

* cited by examiner

RING BINDER MECHANISM

FIELD

Aspects of the invention relate to binder mechanisms for holding articles and more particularly to ring binder mechanisms for holding loose-leaf papers and the like.

BACKGROUND

Ring binders are employed to hold articles, typically loose-leaf papers, documents, and the like. Conventional loose-leaf binders include binder mechanisms having ring segments that abut to form closed loops. The ring segments are separated to facilitate inserting or removing the article to and from the binder. Levers are often employed to help separate the ring segments between the opened and closed positions. Locking mechanisms are also employed to limit inadvertent opening of the rings.

SUMMARY

According to one aspect of the invention, a binder mechanism for binding articles is provided. The binder mechanism includes a base and an elongate ring support rotatably mounted to the base. The elongate ring support includes a plurality of ring members adapted to receive the article. The elongate ring support has an open configuration and a closed configuration. The binder mechanism further includes a locking arrangement having a locking tab disposed on the elongate ring support, and an elongate slide lock slidably mounted relative to the base. The slide lock includes a lock structure having a lock detent defining a cavity thereunder that is constructed and arranged to receive the locking tab when the slide lock is in a first position so that the locking tab is held in the cavity by the lock detent and the elongate ring support is held in the closed configuration. The lock structure also includes a ramp disposed adjacent the cavity that is constructed and arranged to cooperate with the locking tab such that, when the slide lock is moved to a second position and the locking tab is freed from the cavity, the locking tab is urged by the ramp to rotate the elongate ring support toward the open configuration. The locking arrangement also includes a spring disposed between the slide lock and the base. The spring biases the slide lock toward the first position. An over-center spring and lever arrangement cooperates between the base and the elongate ring support and is constructed and arranged to bias the elongate ring support toward a closed direction when the elongate ring support is at least partially in the closed configuration and to bias the elongate ring support toward an open direction when the elongate ring support is at least partially in the open configuration. An opening mechanism cooperates with the slide lock and is constructed and arranged to move the slide lock to the second position. The opening mechanism includes a button and a lever arm pivotally mounted to the base in a manner whereby downward motion of the button results in upward motion of the lever arm. A cam is rotatably mounted to the base and cooperates between the lever arm and the slide lock such that upward movement of the lever arm causes the cam to rotate and push on the slider lock toward the second position.

According to another aspect of the invention, a binder mechanism for binding articles is provided. The binder mechanism includes a base having a mounting surface and an elongate ring support rotatably mounted to the base. The elongate ring support includes a plurality of ring members adapted to receive the article. The elongate ring support has an open configuration and a closed configuration. An opening mechanism is mounted to the base and cooperates with the elongate ring support and is constructed and arranged to move the elongate ring support to the open configuration. The opening mechanism includes a button having a generally horizontal surface that, when the opening mechanism is in a rest position, the horizontal surface is generally parallel to the mounting surface of the base.

According to yet another aspect of the invention, a binder mechanism for binding articles is provided. The binder mechanism includes a base having a mounting surface and an elongate ring support rotatably mounted to the base. The elongate ring support includes a plurality of ring members adapted to receive the article. The elongate ring support has an open configuration and a closed configuration. A cover is constructed and arranged to cover at least a substantial portion of the base and the elongate ring support. The cover includes a cutout and the cover and base define a profile. An opening mechanism is mounted to the base and cooperates with the elongate ring support and is constructed and arranged to move the elongate ring support to the open configuration. The opening mechanism includes a button having a rest position and is disposed at least partially within the cutout. The button is substantially flush with the base and cover so as to be substantially within the profile when the button is in the rest position.

According to still another aspect of the invention, a binder mechanism for binding articles is provided. The binder mechanism includes a base having a mounting surface and an elongate ring support rotatably mounted to the base. The elongate ring support includes a plurality of ring members adapted to receive the article. The elongate ring support has an open configuration and a closed configuration. A cover is constructed and arranged to cover at least a substantial portion of the base and the elongate ring support. The cover includes a cutout and the cover and base define a profile. An opening mechanism is mounted to the base and cooperates with the elongate ring support and is constructed and arranged to move the elongate ring support to the open configuration. The opening mechanism includes a button having a rest position and is disposed at least partially within the cutout. The button has a generally horizontal surface that, when the opening mechanism is in a rest position, the horizontal surface is generally parallel to the mounting surface of the base. The button is substantially flush with the base and cover so as to be substantially within the profile when the button is in the rest position.

According to still another aspect of the invention, a binder mechanism for binding articles is provided. The binder mechanism includes a base and an elongate ring support rotatably mounted to the base. The elongate ring support includes a plurality of ring members adapted to receive the article. The elongate ring support has an open configuration and a closed configuration. The binder mechanism also includes a locking arrangement having a locking tab disposed on the elongate ring support and extending laterally therefrom, and an elongate slide lock slidably mounted relative to the base. The slide lock includes a lock structure having a lock detent defining a cavity thereunder that is constructed and arranged to receive the locking tab when the slide lock is in a first position so that the locking tab is held in the cavity by the lock detent and the elongate ring support is held in the closed configuration. The lock structure also includes a ramp disposed adjacent the cavity that is constructed and arranged to cooperate with the locking tab such that, when the slide lock is moved to a second position and the locking tab is freed from the cavity, the locking tab is urged by the ramp to rotate the elongate ring support toward the open configuration.

Various embodiments of the present inventions provide certain advantages. Not all embodiments of the invention share the same advantages and those that do may not share them under all circumstances.

Further features and advantages of the present inventions, as well as the structure of various embodiments of the present inventions are described in detail below with reference to the accompanying drawings.

BRIEF DESCRIPTION OF THE DRAWINGS

The accompanying drawings are not intended to be drawn to scale. In the drawings, similar features are represented by like reference numerals. For purposes of clarity, not every component is labeled in every drawing. In the drawings.

DETAILED DESCRIPTION

Figure 1:
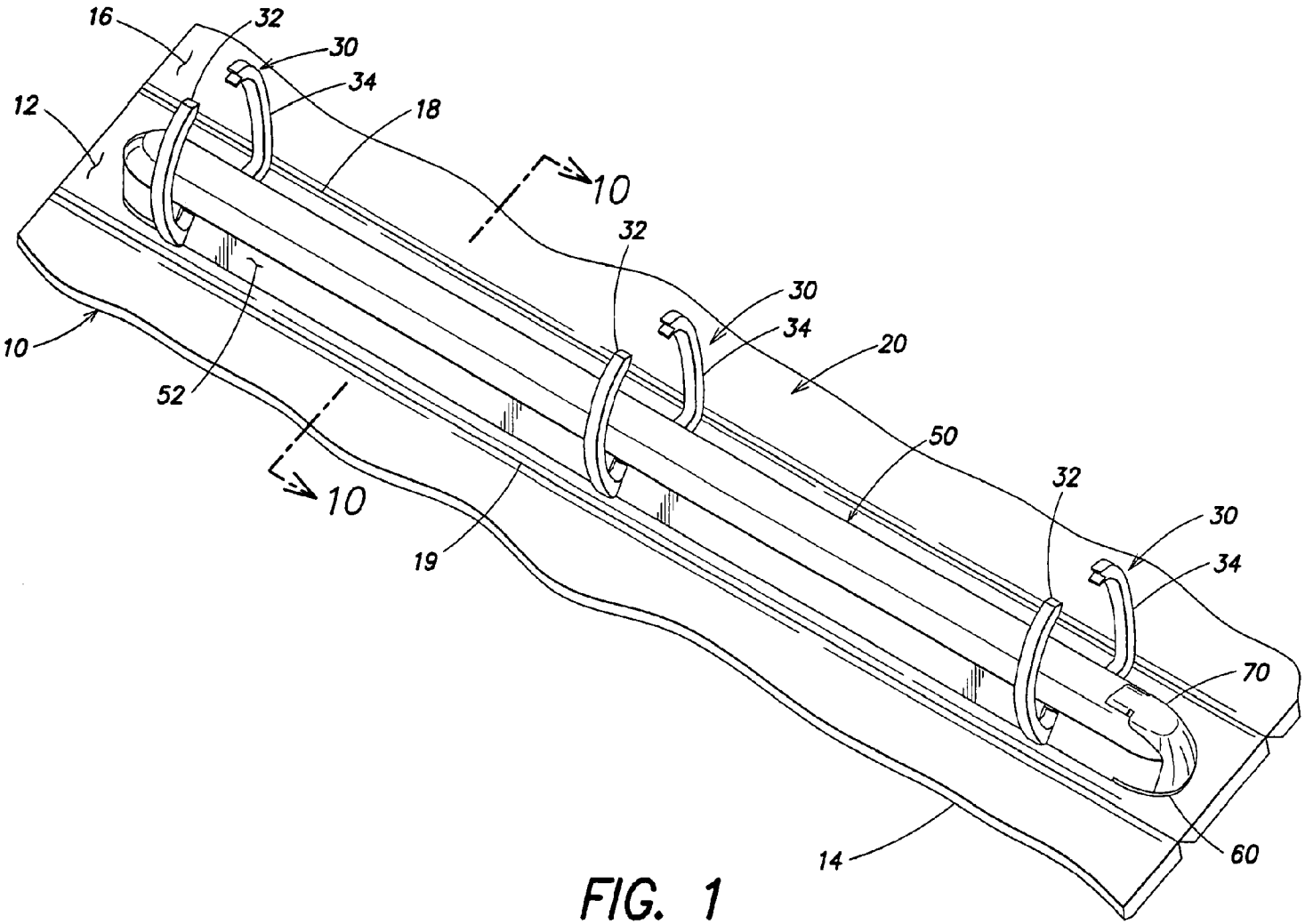
FIGS. 1 and 1A are perspective views of illustrative embodiments of a binder mechanism in an opened position.

The inventions are not limited in its application to the details of construction and the arrangement of components set forth in the following description or illustrated in the drawings. The inventions are capable of being arranged in other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Aspects of the inventions are described below with reference to illustrative embodiments. It should be understood that reference to these illustrative embodiments is not made to limit aspects of the inventions in any way. Instead, illustrative embodiments are used to aid in the description and understanding of various aspects of the inventions. Therefore, the following description is intended to be illustrative, not limiting.

Broadly, the invention is directed to a binder mechanism. The binder mechanism has a base that can be attached to binder panels and includes an elongate ring support rotatably mounted to the base. The elongate ring support includes a one or more ring members that receives an article, such as one or more sheets of loose-leaf paper and other such articles. The ring support can be opened to allow the article to be placed on the rings and closed and locked, as desired.

The binder may include a locking arrangement having a locking tab disposed on the elongate ring support, and an elongate slide lock slidably mounted relative to the base. The slide lock includes a lock structure having a cavity that receives the locking tab when the slide lock is in a first position so that the locking tab is held closed. A ramp is disposed on the slide lock and cooperates with the locking tab such that, when the slide lock is moved to a second position and the locking tab is freed from the cavity, the locking tab is urged by the ramp to rotate the elongate ring support toward the open configuration.

An opening mechanism may be employed that moves the slide lock to the second position. The opening mechanism includes a button and a lever arm pivotally mounted to the base in a manner whereby downward motion of the button results in upward motion of the lever arm.

The button may have a generally horizontal surface that, when the opening mechanism is in a rest position, the horizontal surface is generally parallel to the mounting surface of the base. In addition or in the alternative, the button may be substantially flush with the base and a cover of the binder mechanism so as to be substantially within the profile when the button is in the rest position.

An over-center spring and lever arrangement may be employed. The arrangement biases the ring support toward a closed direction when the ring support is at least partially in the closed configuration and biases the ring support toward an open direction when the ring support is at least partially in the open configuration.

It should be appreciated that various combinations of the above-described features can be employed together; however several aspects of the present invention are not limited in this respect. Therefore, although the specific embodiments disclosed in the figures and described in detail below employ particular combinations of the above-discussed features, it should be appreciated that the present invention is not limited in this respect, as the various aspects of the present invention can be employed separately, or in different combinations. Thus, the particular embodiments described in detail below are provided for illustrative purposes only.

Also, any or all of the these aspects may be employed in a binder mechanism, such as in a three-ring binder mechanism for holding loose-leaf papers and the like; however, the present inventions are not limited in this respect, as aspects may be used in retaining other items included to be bound. Various aspects and embodiments of the inventions will now be described in more detail with respect to the accompanying figures. In some of the figures that follow, specific numerical values are used to describe the numbers of elements and/or performance/size parameters. It should be appreciated that such values are not necessarily limiting, but rather, are merely exemplary only.

Figure 2:
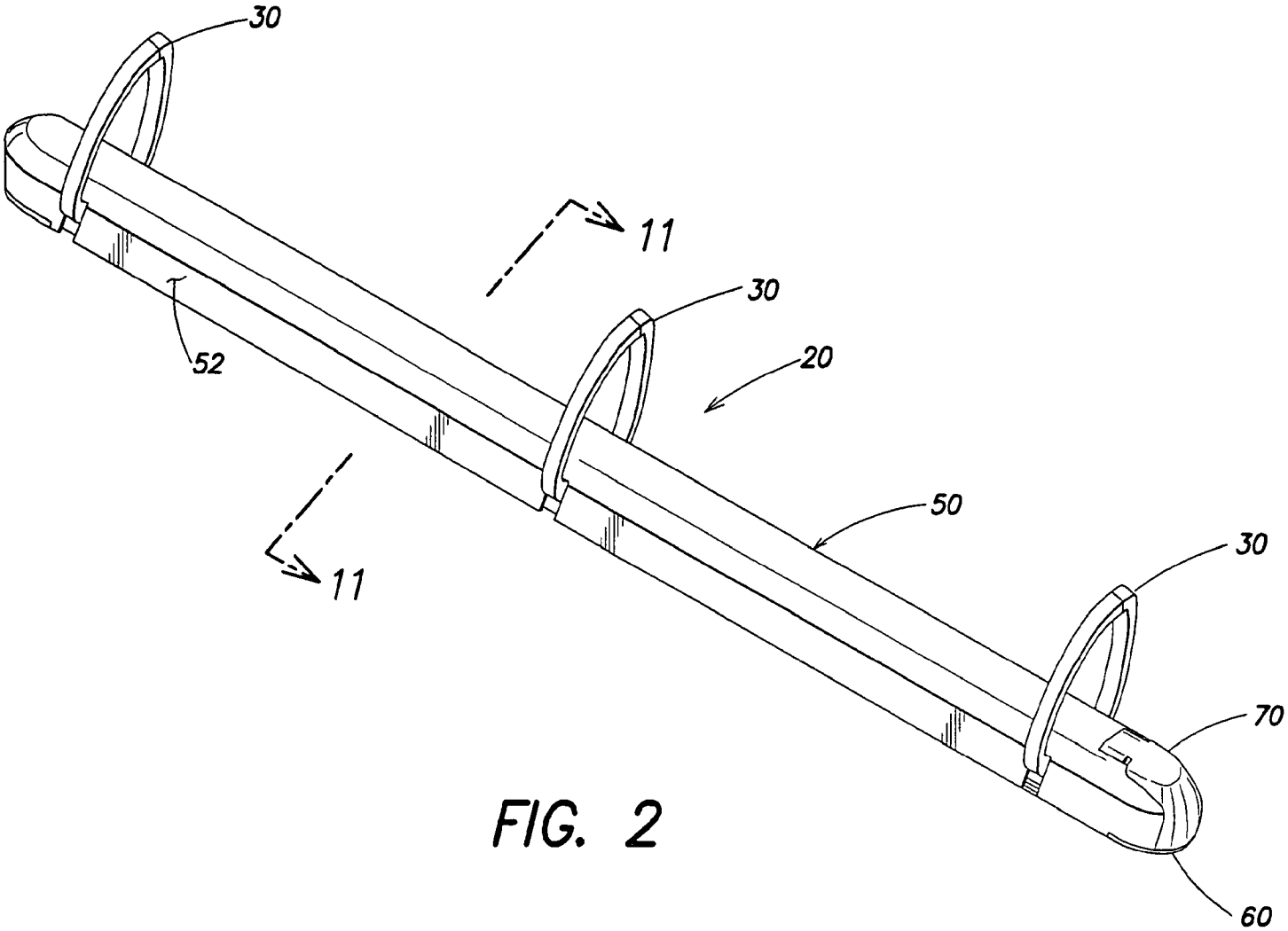
FIG. 2 is a perspective view of the binder mechanism of FIG. 1 in a closed position.

FIGS. 1 and 2 show an illustrative embodiment of a binder mechanism. In this embodiment, the binder mechanism 20 is attached to a binder 10, specifically to spine 12. As is known in the art, the binder 10 includes front and back panels 14, 16 hinged to spine 12 along hinges 18, 19. Binder 10 may be formed in any suitable manner and with any suitable materials, as the present invention is not limited in this respect. Binder mechanism includes rings 30 designed to releasably retain paper, a cover 50 and a base 60 designed to contain the internal components of binder mechanism 20, a button 70 designed to be contacted by a user to open the binder mechanism. Binder mechanism 20 may be selectively and repeatedly moved between a closed position, wherein rings 30 together with cover 50 form a substantially closed loop, as is shown in the embodiment depicted in FIG. 1, and an opened position, wherein movable ring segments 32 of rings 30 are separated from non-movable ring segments 34 of rings 30 creating an opening therebetween, as is shown in the embodiment depicted in FIG. 2.

As shown in the illustrative embodiment in FIG. 1, cover 50 is an elongate shell designed to encase the internal components of binder mechanism 20. In this embodiment, cover 50 extends along the entire length of binder mechanism 20, extends over all rings 30 (with suitable openings to allow the rings to protrude therethrough, as will be described below) and encases most all of the internal components of binder mechanism 20. In alternative embodiments, the cover may extend partially along the length of a binder mechanism, may extend over some, but not necessarily all of the rings, and/or may encase some, but not necessarily all, of the internal components. In another alternative embodiment, the cover may be segmented into multiple portions which may individually cover portions of the components, as the present invention is not intended to be limited in these respects. It should further be appreciated that binder mechanism 20 need not have a cover in all embodiments and/or the functions of the cover may be accomplished by other elements.

In addition to covering the internal components of binder mechanism 20, cover 50 may be designed to give binder mechanism 20 a sleek profile. As shown in the illustrative embodiment in FIGS. 1 and 2, elongate sides 52 and ends 54 of cover 50 are rounded to create a sleek profile. It should be appreciated that the cover may have any shape and any profile, for example, portions of the cover may contain non-radiused edges as the present invention is not intended to be limited in this respect.

Figure 1A:
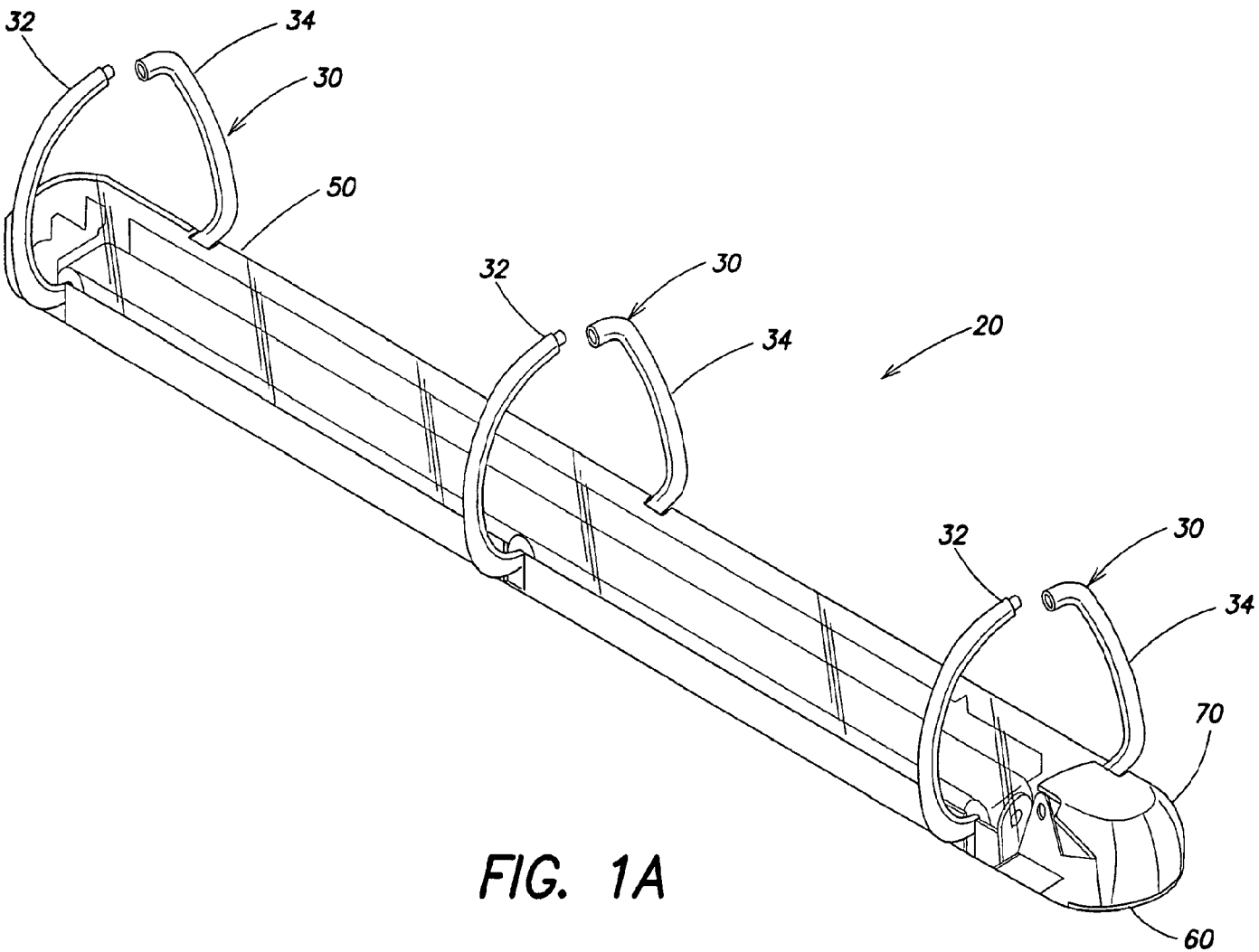

Cover 50 may be constructed from any material or combination thereof and may have any color and any degree of transparency and translucency, as the present invention is not intended to be limited in this respect. For example, the cover may be made from a metal, plastic, composite, or any other material. In one embodiment, cover 50 is made from stamped sheet metal, while in other embodiments, cover 50 is made from a co-molded plastic. In an alternative embodiment, cover 50 is made from a combination of materials, such as a metal and/or plastic coated with a thermoplastic elastomer (TPE). In addition, the material of cover 50 may be any color and may render cover 50 completely opaque, somewhat translucent or completely transparent. In one embodiment, (as shown in FIG. 1A), the cover is completely transparent such that the internal components of the binder mechanism may be viewed through the cover.

To allow for certain components of binder mechanism 20 to be operable and/or user accessible, cover 50 includes cutouts, such as ring cutouts 56, through which rings 30 may extend. Cutouts may have different sizes and shapes to allow for different elements to extend therethrough. In some embodiments, ring cutouts 56 may have a larger profile to allow movement of ring segments therewithin, such as longer ring cutouts or slots 57 which accommodate movable ring segments 32, as shown in the embodiment in FIG. 3. In combination or alternatively, ring cutouts may be substantially the same size as the cross-section of a non-movable ring segment extending therethrough. Ring cutouts may have any size and shape such that they allow the ring to extend therethrough, as the present invention is not intended to be limited in this respect.

Figure 3:
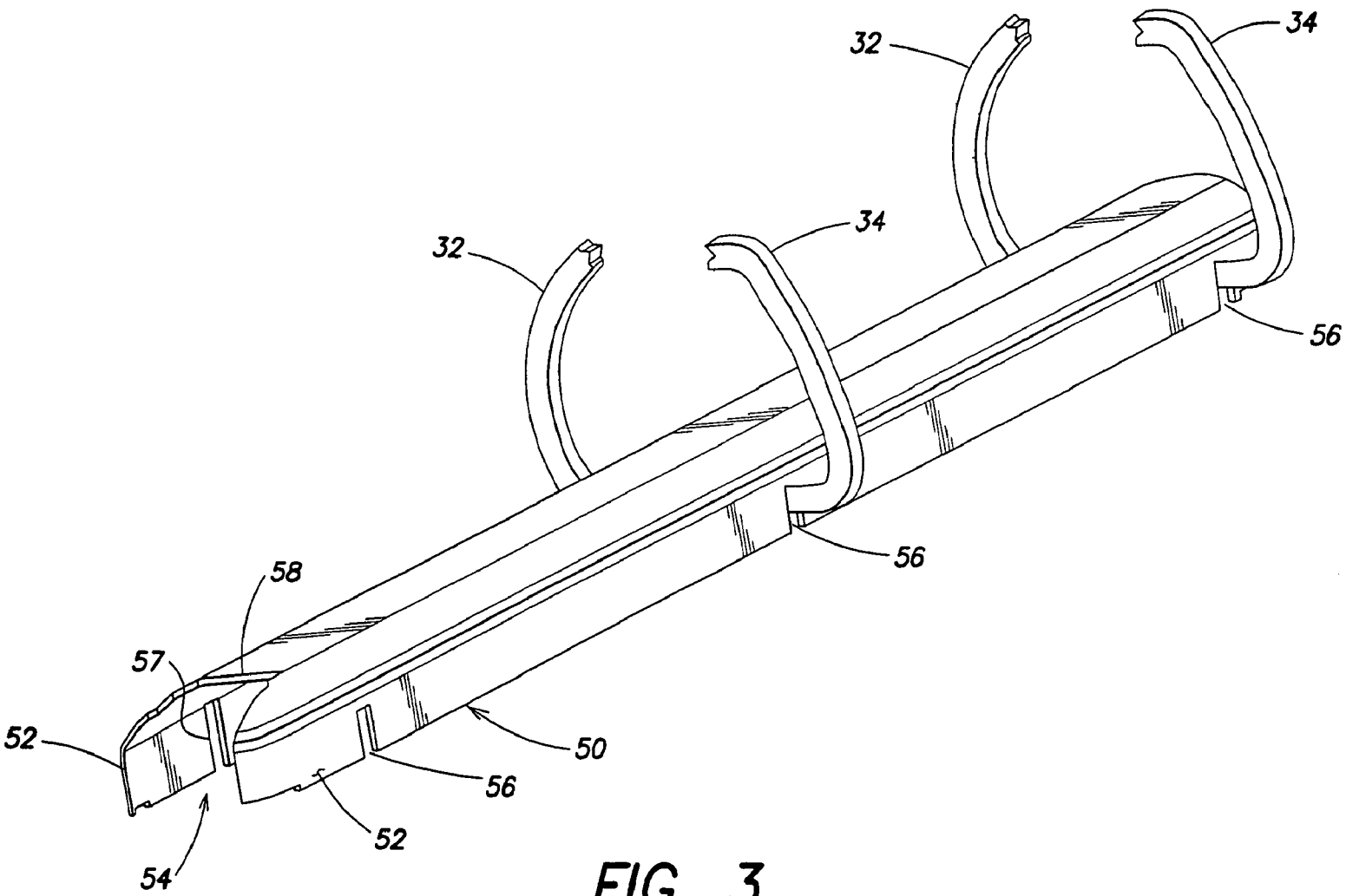
FIG. 3 is a perspective view of an illustrative embodiment of a cover and two movable and two non-movable ring segments.

As shown in the embodiments depicted in FIGS. 1-3, ring cutouts 56 extend all the way to the bottom of cover 50. In an alternative embodiment (not shown), ring cutouts may be encircled on all sides by the cover, such that a portion of the cover forms the bottom most edge of the cover. As shown in the embodiments of FIGS. 1-3, every ring segment has a ring cutout through which it extends. In an alternative embodiment, a cover may be configured to have a larger cutout that contains two or more ring segments. In yet another alternative embodiment (not shown), a ring segment, such as a non-movable ring segment, may be directly attached to or formed with the cover, so that no ring cutouts are necessary for that ring.

In addition to cutouts for rings 30, cover 50 may include a button cutout 58 through which button 70 may extend, so that button 70 is user accessible, as will be explained below. In one embodiment, as shown in FIG. 3, button cutout 58 is located at one end 54 of cover 50. In an alternative embodiment, the button cutout may be surrounded by cover on all sides, such that the cover material makes up the end of the cover. Similar to ring cutouts 56 described above, button cutouts may have any shape and size, as the present invention is not intended to be limited in this respect. In one embodiment as depicted in FIGS. 1 and 2, button cutout 58 has substantially the same shape as button 70, but is slightly larger in size than button 70, thereby allowing button 70 to move without being impinged upon by cover 50. In an alternative embodiment (not shown), the button cutout may be smaller than the button. In this embodiment, the button may be located beneath the cover and the button cutout may serve as a hole through which a user may contact the button.

Figure 4:
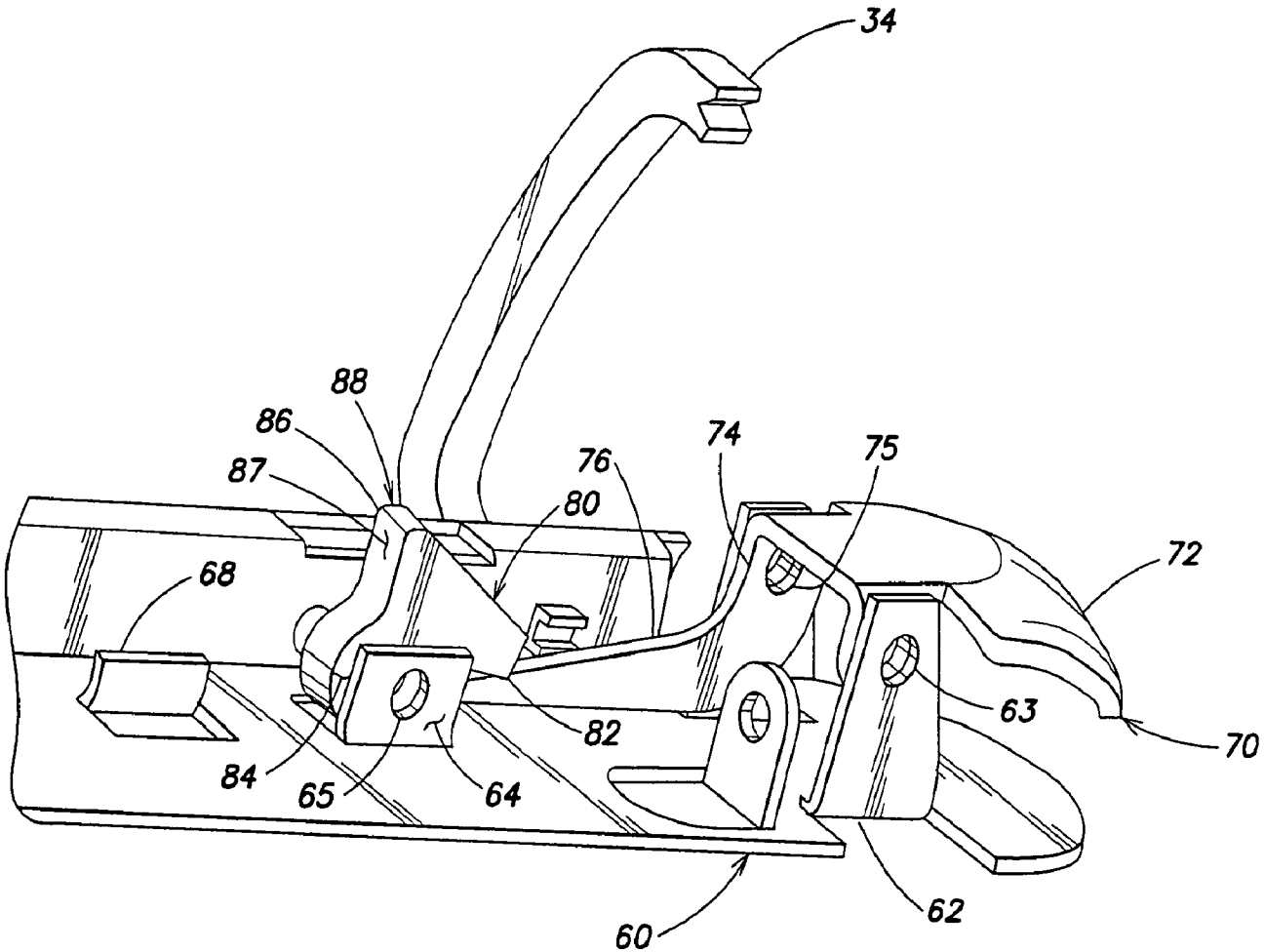
FIG. 4 is a fragmented, perspective view of an illustrative embodiment of a binder mechanism in a closed position having some components removed to better illustrate the configuration and interrelationship of certain components.

As shown in the illustrative embodiment in FIG. 4, the binder mechanism includes an opening mechanism upon which a user may exert a force resulting in the opening of binder mechanism 20. In this embodiment, the opening mechanism includes button 70 formed as a user interface 72 designed to be pushed downwards by a user, a button pivot 74 and a connection arm 76 designed to cooperate with other components of the binder mechanism, as will be discussed further below.

The portion of binder mechanism 20 that a user may contact to open binder mechanism 20 is user interface 72 of the button. As shown in the embodiment in FIG. 4, user interface 72 is a semi-circular tab which rotates downwards when a force is exerted upon the top surface of user interface 72. As shown in this embodiment, the surface of the user interface 72 may be sized and shaped to accommodate a finger or a thumb of a user. In some embodiments, the user interface may be contoured. For example, the user interface may be concavely shaped to mate with a convex profile of a finger. In addition or alternatively the user interface may have any shape, such as a rectangle, triangle, or oval, may have any contour, and any other size or shape as the present invention is not intended to be limited in this respect. Further, the interface may be labeled or embossed with a name or logo.

In one embodiment, as shown in the figures, the user interface 72 includes a generally horizontal surface (which may be contoured as described above, yet still be generally horizontal) that, when the button is mounted to the base and is in the rest position, the surface is generally parallel to the mounting surface of the base. The rest position of the interface is defined as the position it is in when the slide lock is in the first position, as will become apparent below.

In one embodiment, as shown in the figures, the interface 72 is configured to follow the profile of the cover such that the interface is substantially flush mounted with the base and cover when the interface is in the rest position. In this regard, as noted, the cover is constructed and arranged to cover at least a substantial portion of the base, the elongate ring support, the locking arrangement and the over-center spring and lever arrangement. The cover, however, includes a cutout that is adapted to receive the interface. When the button is mounted to the base and the interface portion of the button is within the cutout, the interface remains substantially within the profile formed by the cover and base such that the interface is substantially flush with the base and cover when the button is in a rest position whereby the slide lock is in the first position, as will become apparent below.

To open binder mechanism 20, button 70 may be configured so that user interface 72 is pushed downwards by a user, as depicted in the embodiments of FIGS. 1-2 and 4. In an alternative embodiment (not shown), the button may be configured so that a user pushes the button inwards, towards the rings. In another alternative embodiment (not shown), a lever may be the user interface; the lever may be pulled upwards or pivoted in a direction parallel to or perpendicular to the elongate direction of the binder mechanism. The user interface may have any shape or configuration and may be exerted upon in any direction, as the present invention is not intended to be limited in this respect.

In some embodiments, user interface 72 is moved in a downward direction. This downward direction is translated to an upward direction about button pivot 74. In one embodiment as is shown in FIG. 4, button pivot 74 is located in between user interface 72 and connection arm 76, towards the middle of button 70. As shown in the embodiment of FIG. 4, button pivot 74 cooperates with a button pivot portion 62 of base 60 to create a complete pivot or fulcrum. In one embodiment shown in FIG. 4, button pivot 74 includes two button holes 75 which may be aligned with two base button holes 63 of button pivot portion 62. A shaft or rod (not shown) extends through these holes 63, 75 to complete the pivot point. Although shown the embodiment depicted in FIG. 4, button pivot 74 is shown as being two button holes 75 through which a shaft or axle may extend, it should be appreciated that the present invention is not limited in this respect and the button pivot may include one or two cylinders extending from the button (not shown) (or alternatively from the portion 62) which rotate in corresponding holes of the button pivot portion. Stops may be included to keep the button pivot of the button centered.

The opening arrangement further includes a connection arm 76. As shown in the embodiment depicted in FIG. 4, connection arm 76 is an elongate arm forward to one side of the opening mechanism that tapers along its length and extends downwards from button pivot 74 towards base 60. It should be appreciated that the connection arm may have any shape, size and orientation.

Figure 5:
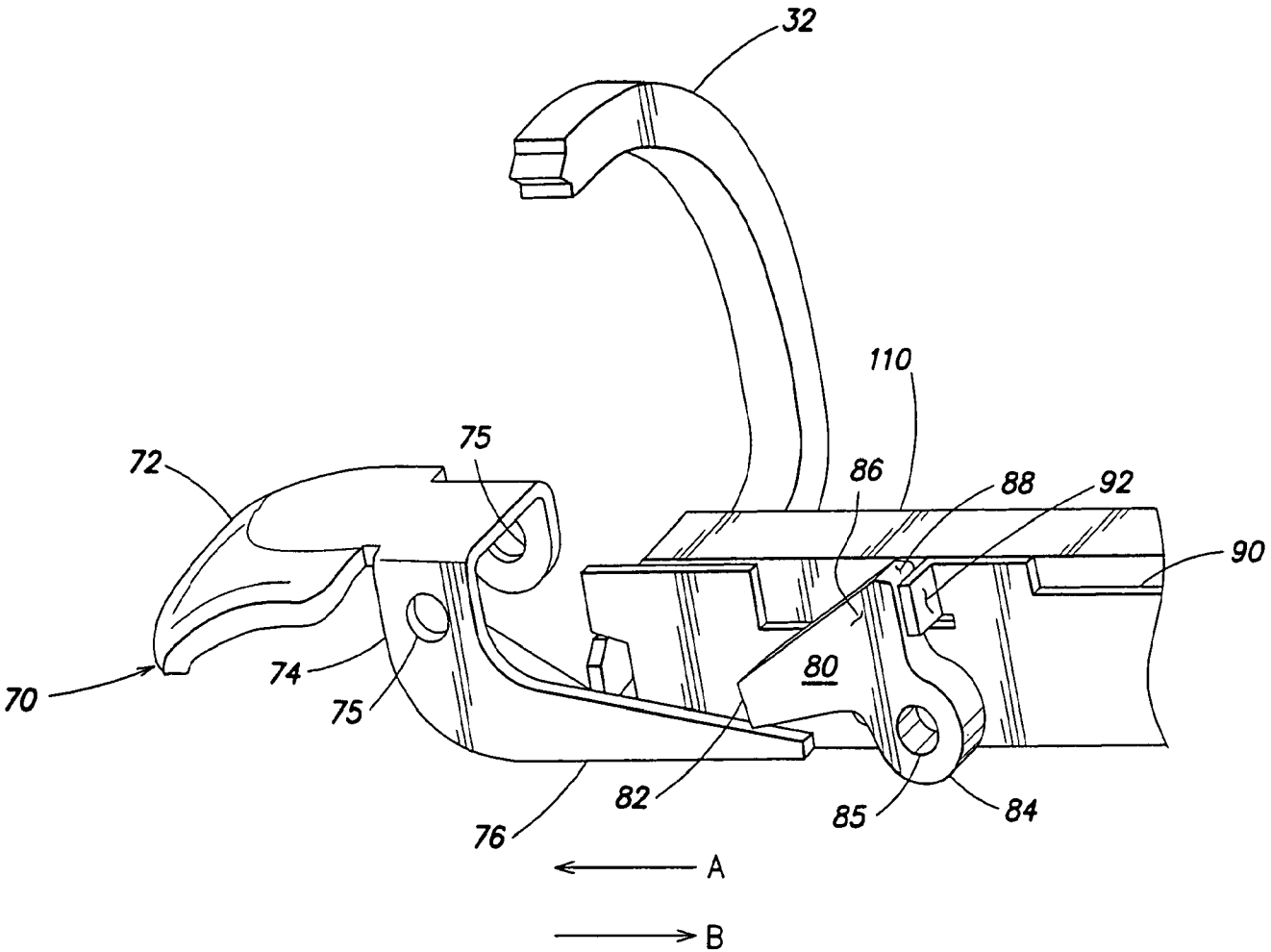
FIG. 5 is a fragmented, perspective view of an illustrative embodiment of the binder mechanism of FIG. 4 as viewed from an opposite side.

As shown in the embodiment of FIGS. 4 and 5, binder mechanism 20 further includes a cam 80. As shown cam 80 includes a cam button portion 82 designed to receive the upwards force exerted by the connection arm of the button, a cam pivot 84 designed to translate the force upwards force into a lateral force and a cam slide lock portion 86.

Cam button portion 82 cooperates with arm 76. In some embodiments, as depicted in FIGS. 4 and 5, cam button portion 82 includes an elongate arm, which tapers along its length, ending in a blunt face. A bottom surface of cam button portion 82 contacts a top surface of connection arm 76. These surfaces may be oriented to become flush or parallel with one another when button 70 is depressed. As discussed above with respect to the connection arm, the cam button portion may have any shape, size and orientation, so long as it cooperates with the connection arm.

Cam 80 is connected to the base via a cam pivot 84. In some embodiments as shown in FIGS. 4 and 5, cam pivot 84 may be located between cam button portion 82 and cam slide lock portion 86. Depending on the desired distance or magnitude of movement of the ends of the cam portions 82, 86, cam pivot 84 may be located closer to one of the ends of the cam portions 82, 86 or may be centered in between the ends of the cam portions 82, 86, as the present invention is not limited in this respect. In addition, although the embodiments depicted in FIGS. 4 and 5 show cam pivot 84 as being a cam hole 85 which aligns with a base cam hole 65 attached to a cam pivot portion 64 of base 60, the cam pivot may have any structure that allows the cam to pivot, as described above with respect to the button pivot.

Cam 80 further includes cam slide lock portion 86. As shown in the embodiments of FIGS. 4 and 5, cam slide lock portion 86 includes a surface 87 designed to sit flush with a slide tab 92 of slide lock 90 (as will be discussed below) when button 70 is not depressed and a rounded end 88 designed to rotate along slide tab 92 as button 70 is depressed. Although in these embodiments, cam slide lock portion 86 has a surface and rounded end, it should be appreciated that the cam slide lock portion need not have this configuration and may be completely rounded, may have faces and edges or may have any other configuration so long as the cam slide lock portion may impart the translated force to the slide lock, as the present invention is not intended to be limited in this respect.

Figure 6:
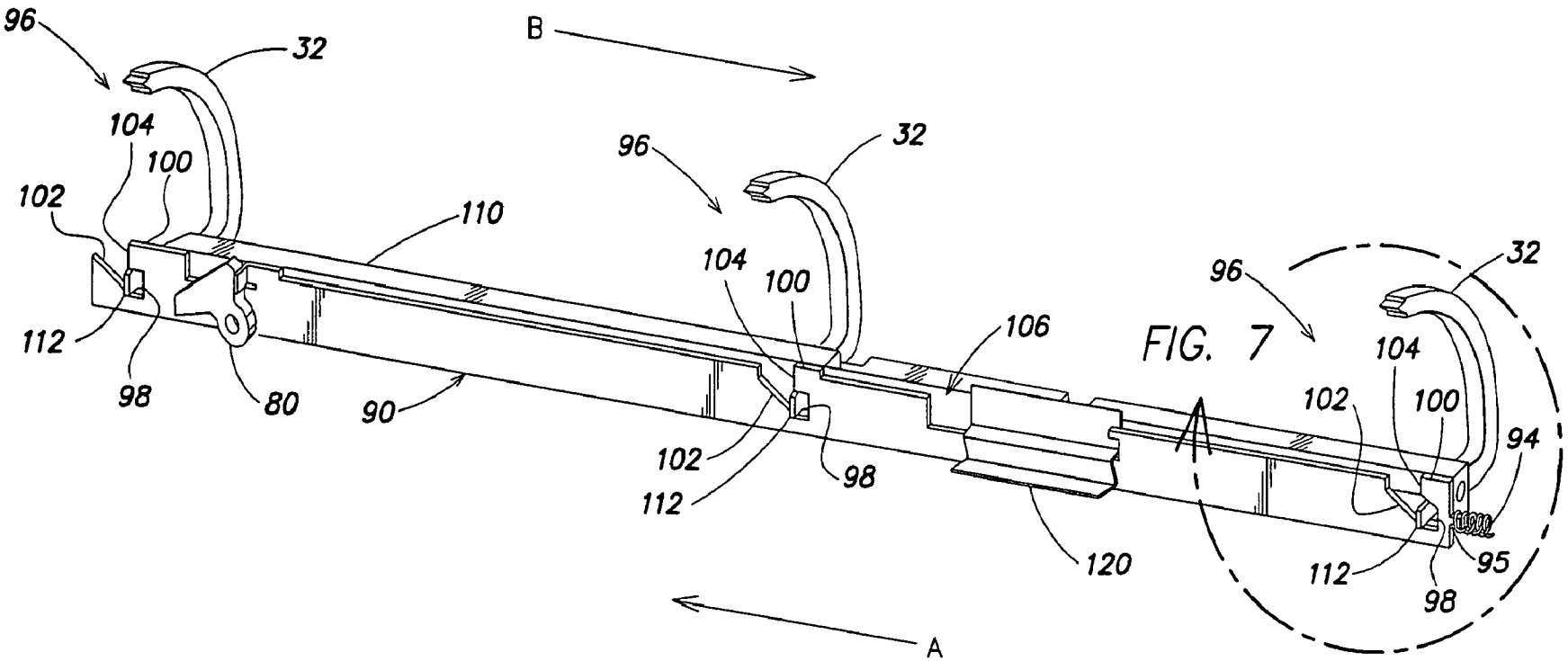
FIG. 6 is a perspective view of an illustrative embodiment of a binder mechanism in a closed position having some components removed to better illustrate the configuration and interrelationship of certain components.
Figure 7:
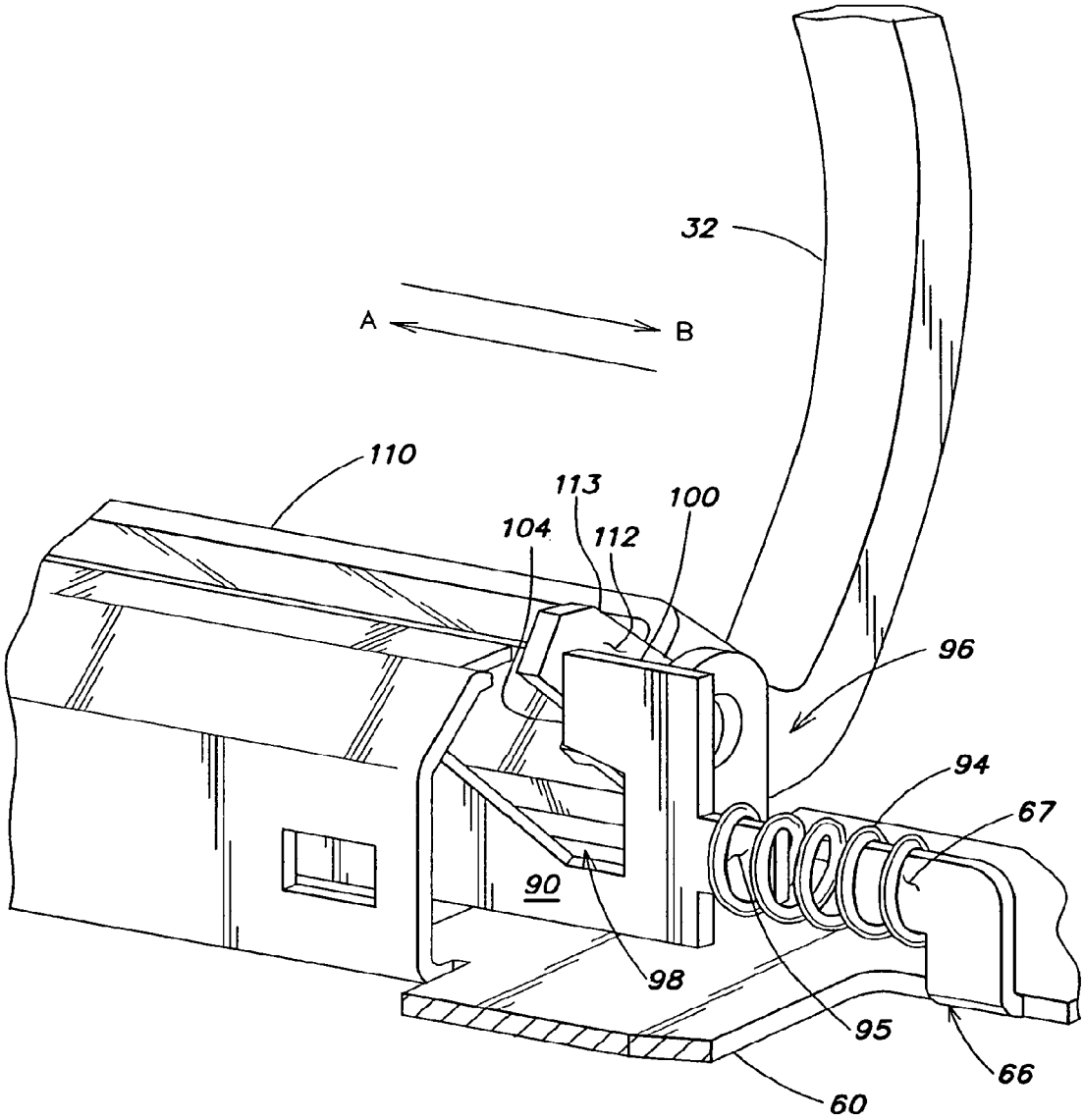
FIG. 7 is an enlarged perspective view of a portion of the binder mechanism encircled by line 7-7 of FIG. 6.

To both lock the movable ring segments closed and encourage these segments to open, a slide lock is provided. While most elements of the binder mechanism are fixed to or may rotate with respect to the base, in one embodiment, the slide lock moves laterally with respect to the base. As shown in the embodiments of FIGS. 5-7, slide lock 90 includes slide tab 92 designed to be pushed upon by cam slide lock portion 86, spring 94 designed to bias slide lock 90 in direction A, e.g., towards button 70, and a lock structure 96 designed to lock the binder mechanism in a closed position, to assist in opening the binder mechanism and to ensure that moving the binder mechanism between an opened and closed position may be repeated. A cutout 106, which will be explained in more detail below, is also formed on the slide lock. To enable slide lock 90 to move laterally along base 60, slide lock 90 may be positioned in-between slide lock guides 68 on base 60.

The portion of slide lock 90 which receives a force against the spring bias (e.g., from cam 80) is slide tab 92. As shown in the embodiments of FIGS. 5 and 6, slide tab 92 is formed as a portion of slide lock 90 that is bent so that the major surface of slide tab 92 is perpendicular to the length of slide lock 90, thereby creating a major surface which may be pushed against by cam 80. Although in these embodiments, slide tab 92 is constructed to interact with surface 87 and rounded end 88 or cam slide lock portion 86, it should be appreciated that depending on the configuration of cam slide lock portion 86, slide tab 92 may have a different configuration, as the present invention is not intended to be limited in this respect. For example, in one embodiment (not shown) the cam slide lock portion may be tapered to a pointed end, thus the slide tab may have a concave surface facing the cam slide lock portion designed to receive the pointed end. In addition or alternatively, the configuration of the slide tab may be dependent upon the biasing of the slide lock. For example, if the slide lock were designed to be biased in direction B, e.g., counter direction A, the slide tab may be positioned to receive a force against this bias (e.g., receive a force in direction A).

To bias slide lock 90 so that it may retain the movable ring segments in a closed and locked position, slide lock 90 may include spring 94 at one end thereof. In the embodiments depicted in FIG. 6, spring 94 is a coil spring located at the end of slide lock 90 opposite the button. Spring 94 may be coupled to slide lock 90 at one end and a slide lock spring portion 66 of base 60 at the other end. In the above-mentioned embodiments wherein spring 94 is a coil spring, one end of spring 94 is positioned over a slide lock projection 95 and the other end is positioned over a slide lock spring projection 67 of slide lock spring portion 66. It should be appreciated that the spring is not limited to a compression coil or helical spring and may be any torsion spring, leaf spring, gas spring, spiral spring, cantilever spring, elastomeric spring, or any other type of biasing member as the present invention is not limited in this respect. It should be further appreciated that the spring need not have only one bias and may be an over center spring or may have two or more biases, as the present invention is not limited in this respect.

Lock structure 96 may be designed to retain the movable ring segments in closed position, to assist in moving the movable ring segments into an opened position, and inhibit slide lock 90 from completely returning to its fully biased positioned (e.g., the position depicted in FIG. 6, wherein slide lock 90 is biased towards button 70, thereby ensuring that the binder mechanism may be repeatedly opened and closed. In order to perform these functions, in some embodiments (as best shown in FIG. 7), lock structures 96 interact with lock tabs 112, which are configured in a fixed relationship with movable ring segments 32.

In these embodiments, each lock structure 96 may include a lock detent 100 defining a cavity 98 thereunder, a ramp 102 and an opening surface 104 on lock detent 100. Cavity 98 may be designed to hold lock tab 112 when the binder mechanism is in a closed position. Lock detent 100 may be positioned above cavity 98 to inhibit lock tab 112 from rotating upwards (thereby inhibiting the binder mechanism from opening).

The opening surface cooperates with lock tab 112 to inhibit the slide lock from returning to its fully biased position. Because the slide lock may be biased in direction A, if the lock tab were to fully clear the lock structure, so that the lock tab was above the lock structure (e.g., not in the cavity or on the ramp), there may not be a structure to inhibit the spring from biasing the slide lock too far in direction A, such that the lock tab may not be able to reenter the lock structure upon closing, as will become apparent hereinafter. As shown in the embodiments of FIGS. 5-7, by positioning opening surface 104 on lock detent 100 so that it may contact a surface of lock tab 112 when the binder mechanism is in an opened position, opening surface may inhibit slide lock 90 from being biased too far in direction A. It should be appreciated that the function of the opening surface may be performed by a variety of structures in the lock structure or may be performed by a separate structure, such as a stop at the button end of the binder mechanism (not shown), as the present invention is not intended to be limited in this respect.

Ramp 102 may be positioned adjacent cavity 98 and lock detent 100, such that as soon as slide lock moves in direction B and detent 100 clears lock tab 112, lock tab 112 encounters ramp 102. Ramp 102 may be angled upwards from the base of cavity 98 at an angle of 35 degrees to encourage lock tab 112 to move upwards and may end when the surface of ramp 102 reaches the height of the bottom of lock detent 100. In one embodiment, ramp 102 may be long enough to position lock tab 112 just upwards enough to urge the binder mechanism open. It should be appreciated that the ramp may have any angle, such as 25-50 degrees, less than 25 degrees and more than 50 degrees, any length and any location relative to the lock detent and the cavity, as long as ramp may assist in opening the binder mechanism, as the present invention is not intended to be limited in this respect.

As shown in the embodiment depicted in FIG. 6, slide lock 90 includes three lock structures 96, each lock structure 96 corresponding to a movable ring segment 32. In some embodiments, such as those wherein all movable ring segments are fixedly connected to one another, such as by a rotating holder 110, a slide lock may only include one lock structure which controls the opening and locking of all of the movable ring segments. In one embodiment, this single lock structure may be located in the middle of the slide lock. In an alternate embodiment, this single lock structure may be located at one end of the slide lock, such as proximate the button. In another embodiment, a slide lock may include two lock structures, one at each end of the slide lock. In addition or alternatively, the number of lock structures may or may not be the same as the number of movable ring segments or lock tabs. For example, one embodiment may include three movable ring segments, two lock structures and one lock tab. It should be appreciated that the slide lock may include any number of locking structures, such as one, two, three, four or more, which may or may not correspond to the number of moveable ring segments or lock tabs, and these locking structures may be positioned anywhere along the slide lock, as the present invention is not intended to be limited in any of these respects.

To synchronize the movement of all the movable ring segments and to enable the movable ring segments to be controlled by a single control mechanism, such as one lock structure 96, the binder mechanism may include a rotating holder, to which all of the movable ring segments may be supported or connected. As shown in the embodiment depicted in FIG. 8, rotating holder 110 is an elongate, rod-like member designed to rotate relative to base 60 and may include lock tabs 112 designed interact with locking structures 96 to lock the binder mechanism closed and assist in opening the binder mechanism as described above. Holder 110 also includes movable ring segments 32 to releasably retain articles.

Figure 8:
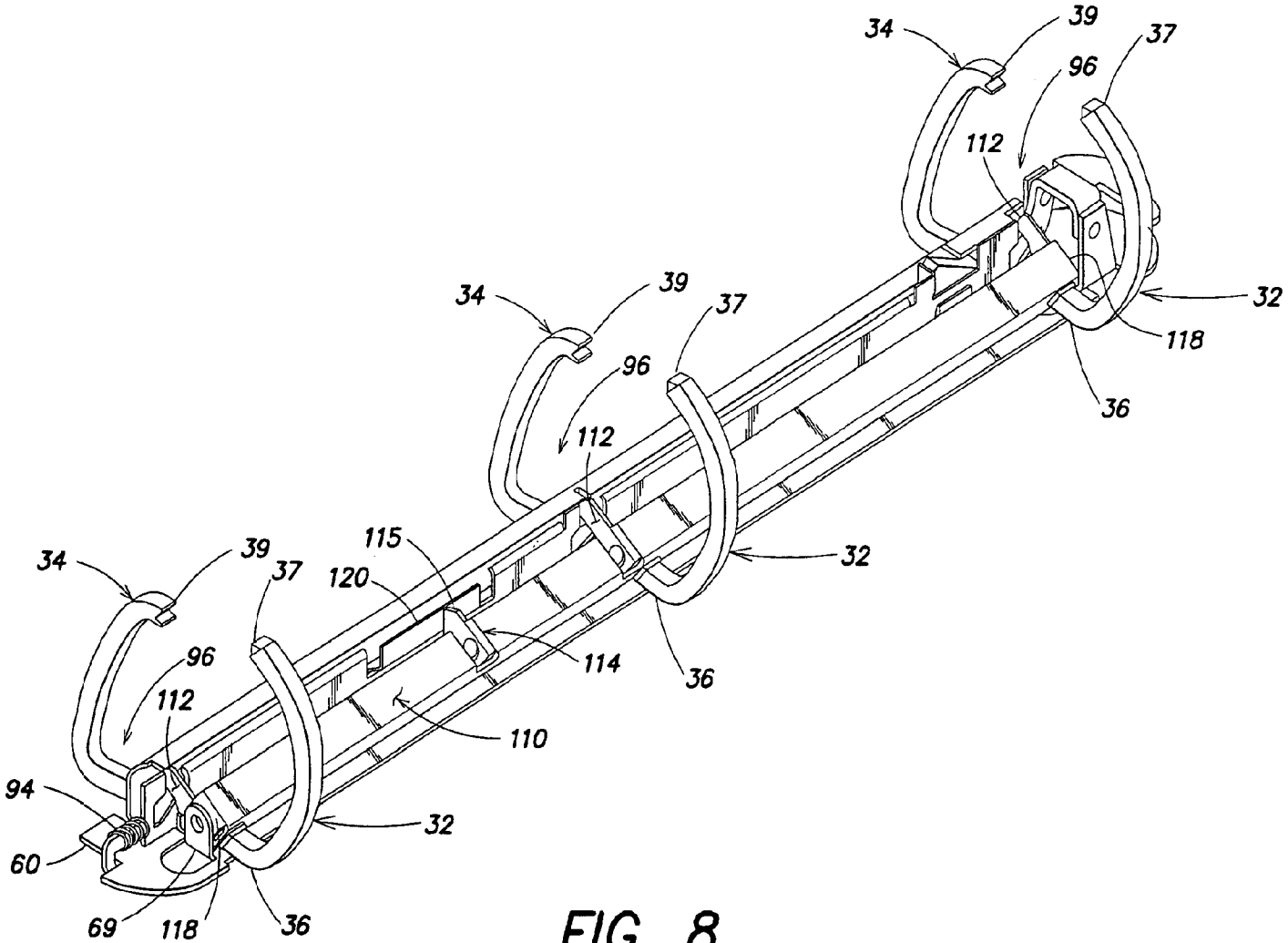
FIG. 8 is a perspective view of an illustrative embodiment of a binder mechanism in an opened position having some components removed to better illustrate the configuration and interrelationship of certain components.

Rotating holder may be designed to rotate with respect to the base. As shown in the embodiments of FIG. 8, ends 118 of rotating holder may cooperate with rotating holder portions 69 of base 60 to create a pivot point or fulcrum. The pivot may include holes (as shown) through which a shaft may be inserted, one or two cylinders extending from the rotating holder portion 69 or ends 118 that may rotate in holes of the other 118, 69, or any fulcrum or other structure that allows the rotating holder to rotate relative to the base, as the present invention is not limited in this respect. In addition, it should be appreciated that the rotation enabling portion of the rotating holder need not be a part of the ends and may be connected to or integral with any portion of the rotating holder, as the present invention is also not limited in this respect. In addition or alternatively, a hinge may extend along the length of the rotating holder, wherein one part of the hinge is connected to or integral with the rotating holder and another part of the hinge is connected to the base or other part of the binder mechanism.

The portion of the rotating holder which controls the opening and locking of the movable ring segments is the lock tab. Lock tab 112 may be a portion of rotating holder 110 which may be bent so that the major surface of lock tab 112 is perpendicular to the length of rotating holder 110. As explained, this major surface of lock tab 112 may interact with opening surface 104 of slide lock 90 to prevent spring 94 from biasing slide lock 90 into its fully biased position. In addition, when the binder mechanism is in a closed position, a top surface 113 of lock tab 112 may abut against lock detent 100 to inhibit movable ring segments 32 from opening. Although the embodiments shown in the figures depict rotating holder having three lock tabs 112, it should be appreciated that the rotating holder may include any number of lock tabs, which may or may not correspond to the number of lock structures or movable ring segments, and these lock tabs may be positioned anywhere along the rotating holder, as the present invention is not intended to be limited in these respects.

Figure 9:
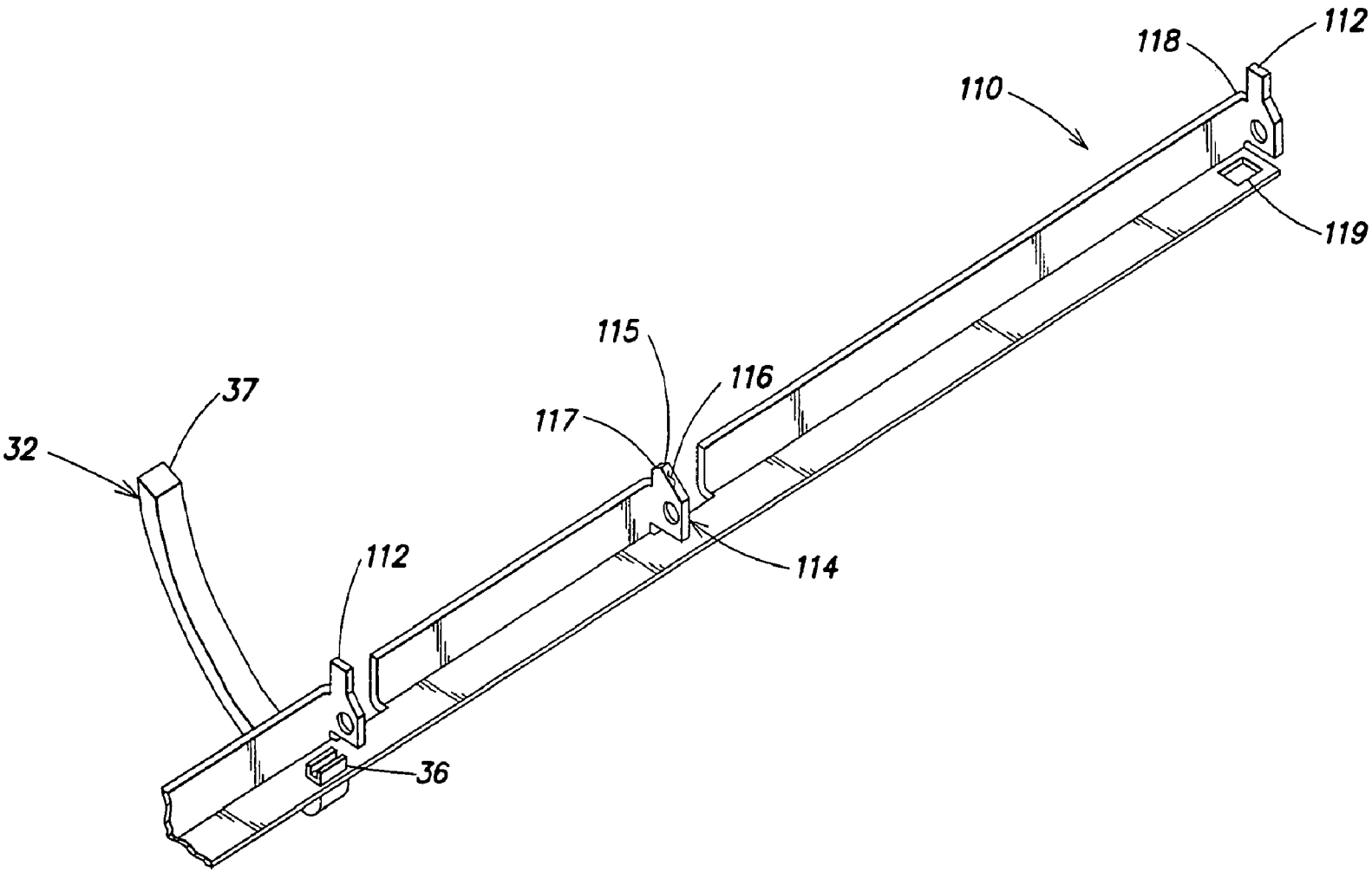
FIG. 9 is a fragmented, perspective view of an illustrative embodiment of a portion of rotating holder and a movable ring segment.

To releasably retain papers or other documents or materials, movable ring segments may be movable from a closed position wherein they contact other ring segments to form, a substantially closed loop to an opened position wherein they are spaced from the other ring segments to form an opening in the loop so that items may be inserted. As shown in the embodiments of FIGS. 8 and 9, each movable ring segment 32 may be a "C" shaped member wherein a first end 36 of movable ring segment 32 may be inserted into a ring hole 119 and a second end 37 of movable ring segment 32 may be designed to mate with non-movable ring segment 34 when the binder mechanism is closed and designed to be freestanding when the binder mechanism is opened. First end 36 may be secured to rotating holder 110 using any type of fastener, such as a locking double wedge (as shown in FIG. 9), a snap, a clasp, a button, a clip, a grommet, and/or a pin. Alternatively, first end may be integrally formed, welded or adhesively secured, as desired. In addition or alternatively, the movable ring segments may have any shape, such as semi-circular, "D" shaped, and may have edges, arcs or any combination thereof. Further, although second end 37 is shown to have a triangular protrusion (which mates with a triangular indentation in a second end 39 of non-movable ring segment), the second end may have any configuration, such as a flat, convex or concave surface, a cone, a cylinder, or any combination thereof, which may or may not mate with second end 39. The present invention is not intended to be limited with respect to any of the above-mentioned features.

Figure 10:
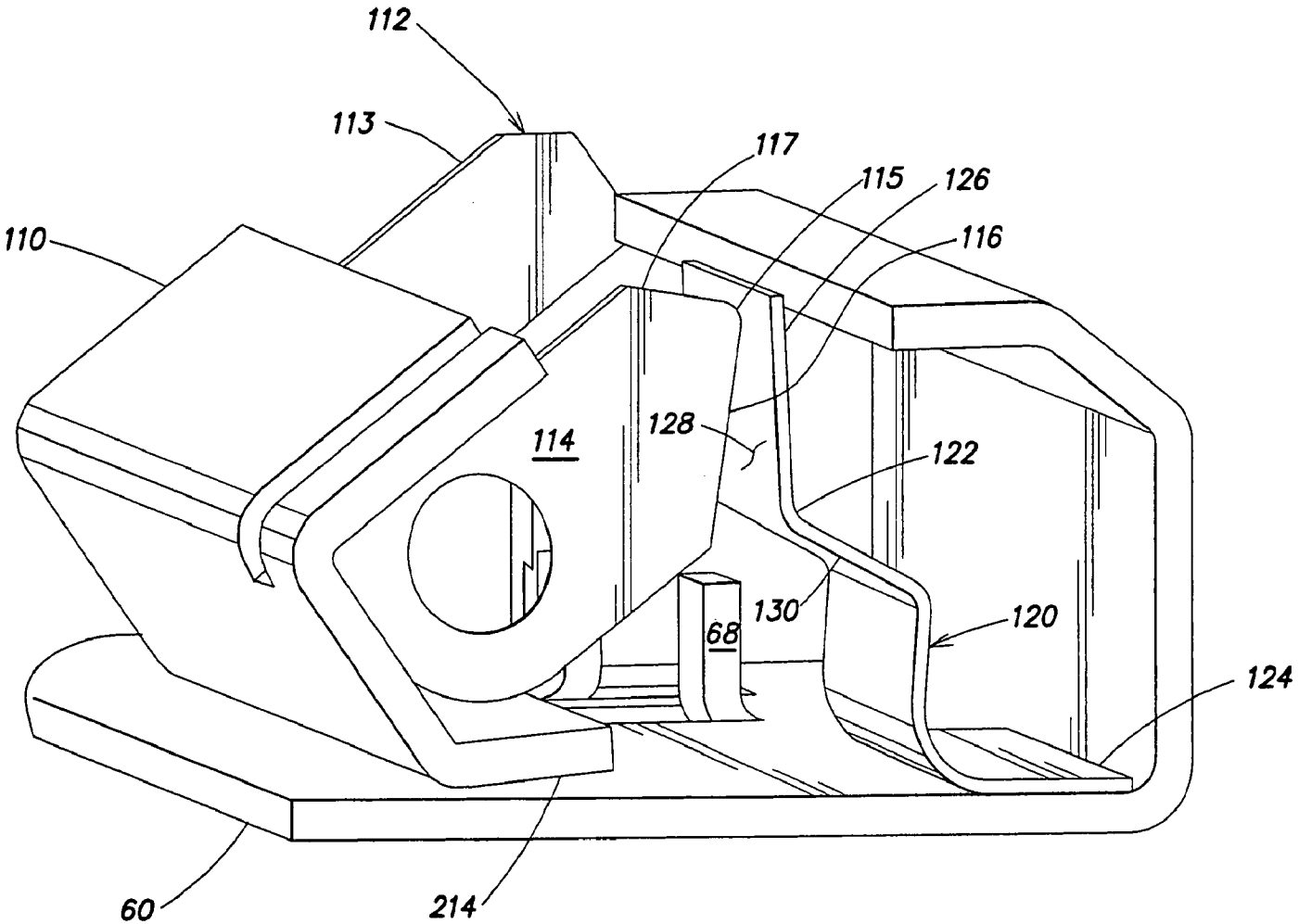
FIG. 10 is an enlarged, cross-sectional perspective view of an illustrative embodiment of a portion the binder mechanism taken along line 10-10 of FIG. 1.
Figure 11:
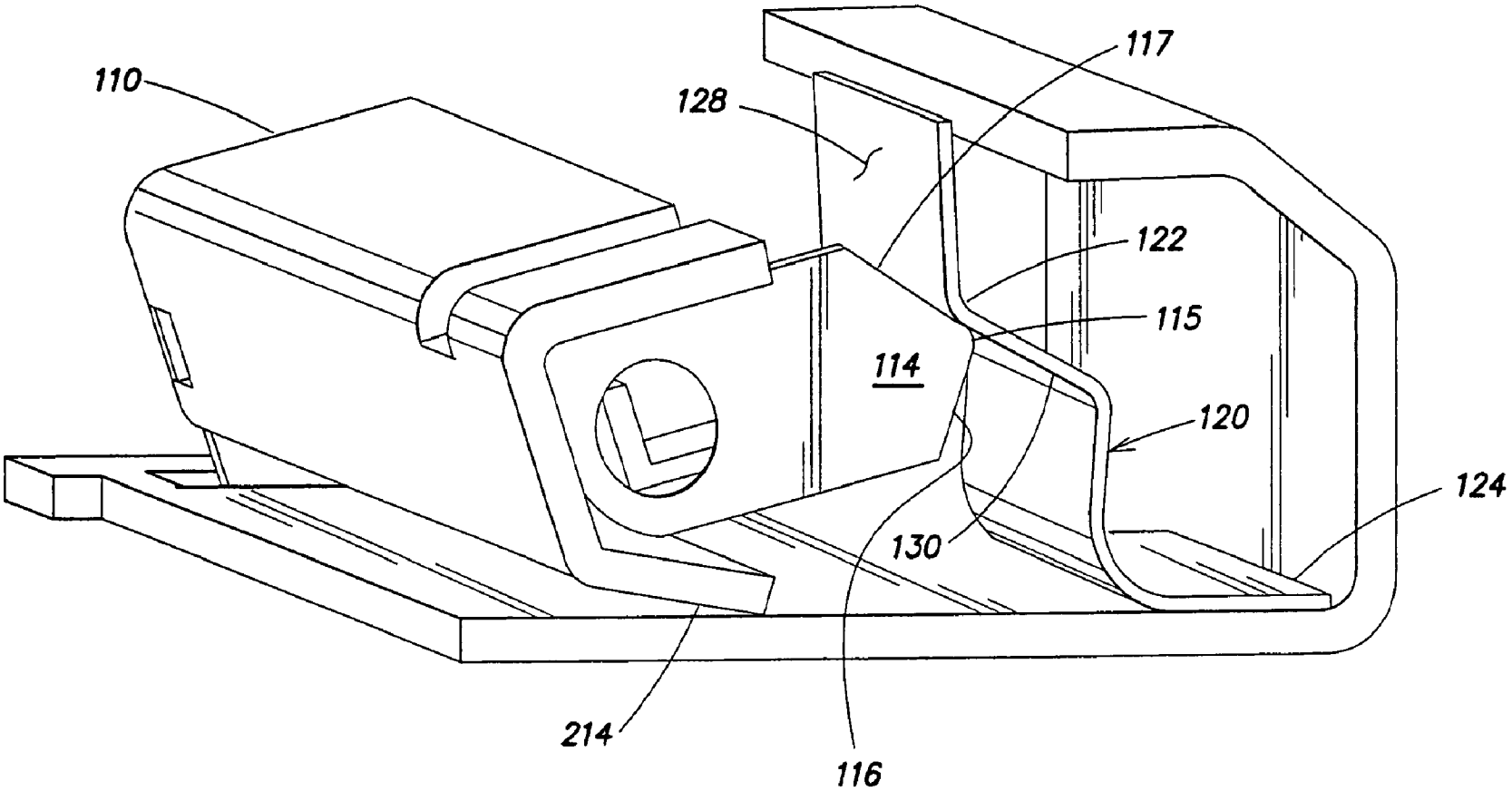
FIG. 11 is an enlarged, cross-sectional perspective view of an illustrative embodiment of the binder mechanism taken along line 11-11 of FIG. 2.

As shown in the embodiments depicted in FIGS. 10 and 11, the rotating holder includes protrusion 114 extending therefrom. Protrusion 114 may have two surfaces, e.g., protrusion opened surface 116 and protrusion closed surface 117, leading up to an apex-like structure 115. The apex-like structure need not be a point and may have a rounded tip.

In order to assist in both biasing the movable ring segments into an opened position and biasing the non-movable ring segments into a closed position, an over-center spring may be used. As depicted in the embodiments of FIGS. 10 and 11, over-center spring 120 is a "W" shaped, cantilever, leaf spring. In these embodiments, a first end 124 of over-center spring 120 may be fixed or held to base 60. A second end 126 of over-center spring 120 may include center 122. Center 122 cooperates with protrusion 114. In these embodiments, center 122 is bordered by face 128 and face 130. Faces 128, 130 may be configured to respectively complement surfaces 116, 117 of protrusion 114, such that when the binder mechanism is in an opened position (as shown in the embodiment depicted in FIG. 10), surface 116 of protrusion 114 contacts face 128 of spring 120 and when the binder mechanism is in a closed position (as shown in the embodiment depicted in FIG. 11), surface 117 of protrusion 114 contacts face 130 of spring 120.

It should be appreciated that the over-center spring may include any over-center mechanism incorporating any type of biasing mechanism, such as a coil spring or gas spring, and/or any include two separate biasing mechanisms to accomplish the function of biasing the movable ring segments open in the opened position and closed in the closed positions, as the present invention is not limited in this respect. In addition or alternatively, although over-center spring 120 is shown in the embodiments of FIGS. 10 and 11 as being located between the two ring segments 32, 34 distal of button 70 and having first end 124 connected to base 60, it should be further appreciated that the over-center spring may be located anywhere along the binder mechanism and may be connected to any component of the binder mechanism, as the present invention is not intended to be limited in this respect. For example, over-center spring may be located underneath the rotating holder and the over-center spring projection may be incorporated into the structure of the elongate, rod-like structure of the rotating holder, such as a structure like element 214 in FIGS. 10 and 11. Further, it should be appreciated that the spring bias of the over-center spring need not exert a force on the protrusion once the rotatable member is completely in the opened or closed configuration. That is, the spring and protrusion arrangement may be constructed such that although the rotatable member is urged or biased in a direction, the biasing force can drop to zero once the rotatable member is in the corresponding configuration. Thus, the bias on the protrusion may occur when the protrusion is at least partially in the closed or open configuration.

As discussed above, slide lock moves laterally with respect to the base. To permit the slide lock to move freely while maintaining all of the components within a slim binder mechanism profile, slide lock includes a cutout 106 to accommodate spring 120, as shown in the embodiment depicted in FIG. 6. Cutout 106 allows slide lock 90 to move laterally, along direction A, without abutting over-center spring 120. Cutout 106 is a rectangularly shaped cutout. The lateral length of cutout 106 should account for movement of slide lock 90 and be at least the lateral length of over-center spring 120 plus the lateral distance that slide lock 90 moves. It should be appreciated that the cutout may have a different shape or configuration, the over-center spring may be positioned such that it does not contact the slide lock at any time, or any other configuration, so long as the slide lock does not hinder the function of the over-center spring, as the present invention is not intended to be limited in this respect.

The binder mechanism 20 further includes a base. The base may be used as a means of attachment to connect the binder mechanism to a binder 10, as a means of fixed and/or rotatable attachment for the internal components of the binder mechanism and/or together with the cover, as a means of encasing the components of the binder mechanism. In some embodiments as shown in FIGS. 4, 7, 8 and 10-12 and as described above with respect to other components, base 60 includes a mounting surface 59 that may have holes (not shown) formed therein to mount the base to the binder 10; pivot accepting portions: button pivot portions 62, cam pivot portions 64, rotating holder portions 69; fixed member accepting portions: spring projection 67 and non-movable ring segment holes 61; slide member accepting portions; and slide lock guides 68. As described above, although depicted in the embodiments of the figures as being shaft-accepting holes, pivot accepting portions 62, 64, 69 may have any structure and/or configuration as long as it allows the element connected thereto to pivot relative to the base. Even though shown in the depicted embodiments as being a tab onto which spring 94 may be inserted, spring projection 67 may have any shape and /or configuration to which a coil spring may be connected or may have any other form to which any spring-like member, such as a gas spring, flexible hinge, or leaf spring, may be connected. Further, slide lock guides may have any configuration as long as they allow the slide lock to move laterally relative to the base. Similar to ring holes 119, base 60 may include base ring holes 61 into which non-movable ring segments 34 may be inserted. In addition or alternatively, non-movable ring segments may be formed integrally with the base.

Although base 60 is depicted as an integrally formed component with all of the above-mentioned elements, these elements may be formed separately from the base and/or from one another. For example, in one embodiment, the non-movable ring segments may be connected to a separate structure (not shown) which is then connected to the base. In another embodiment, the spring projection may be attached to the cover, as opposed to the base. The present invention is not intended to be limited in any of the above-mentioned respects.

The movable ring segments may cooperate with non-movable ring segments to form a loop, to releasably retain papers or other articles. As shown in the embodiments of FIGS. 1-4, 8 and 12, each non-movable ring segment 34 may be a "C" shaped member wherein a first end 38 of non-movable ring segment 34 may be inserted into base ring hole 61 and a second end 39 of non-movable ring segment 34 may be designed to mate with second end 37 of movable ring segment 32 when the binder mechanism is closed and designed to be freestanding when the binder mechanism is opened. As described above with respect to movable ring segment, the first end may be secured to the base using any type of permanent or removable fastener and/or may be formed integrally with the base or any other component, the non-movable ring segment may have any shape, and/or the second end may have any configuration as the present invention is not intended to be limited in any of these respects.

The operation of the binder mechanism will now be explained. As described briefly above, the binder mechanism may be repeatedly convertible between a closed position, wherein second ends 37, 39 of respective ring segments 32, 34 are proximate on another, as shown in the embodiment of FIG. 2, and an opened position wherein second ends 37, 39 are distanced from one another, as shown in the embodiment of FIG. 1.

As is shown in the embodiments depicted in FIGS. 2, 4-6 and 11, the binder mechanism is in a closed position; thus, second ends 37, 39 of respective ring segments 32, 34 are proximate one another. As can be seen in the embodiments depicted in FIGS. 4-6, spring 94 is extended and biases slide lock 90 in direction A, which causes slide tab 92 to push against cam slide lock portion 86 in direction A. This causes cam button portion 82 to be pushed downwards onto connection arm 76, causing user surface 72 of button 70 to be flush with cover 50. In addition, lock tab 112 may be within cavity 98 and underneath lock detent 100. Further, as may be seen in the embodiment of F*ig*. 11, face 117 is below over-center point 122 and is biased downwards by spring face 130. Due to the position of over-center spring 120 and lock tab 112 (as may be seen in the embodiments of FIGS. 5 and 11), rotating holder 110 is close to base 60 and movable ring segments 32 are in their closed position.

If a user were to pull on movable ring segments 32 in an attempt to open the binder mechanism, the binder mechanism is held in a closed position. As may be seen in the embodiment of FIG. 5, top surface 113 of lock tab 112 contacts lock detent 100, thereby prohibiting rotating holder 110 and movable ring segments 32 from pivoting open. In addition, as may be seen in the embodiment of FIG. 11, face 117 of protrusion 114 is engaged with spring face 130. The biasing closed of over-center spring 120 urges protrusion 114 downwards, thereby inhibiting rotating holder 110 and movable ring segments 32 from pivoting open.

Referring to FIG. 5, to open the binder mechanism, a user presses downwards upon user interface 72 of button 70. This downwards force on user interface 72 causes button 70 to pivot about button pivot 74 and connection arm 76 to move upwards. The upwards movement of connection arm 76 presses upwards on cam button portion 82. As cam button portion 82 is pushed upwards, cam 80 pivots about cam pivot 84 and causes cam slide lock portion 86 to move against the spring bias of slide lock 90, e.g., in direction B. Cam slide lock portion 86 exerts a force in direction B against slide tab 92, causing slide tab 92 and slide lock 90 to move in direction B.

As discussed above, when the binder mechanism is in the closed position, lock tab 112 may be held within cavity 98 by lock detent 100. As can be seen in FIG. 6, as slide lock 90 is moved in direction B, lock detent 100 moves in direction B, such that lock detent is no longer above lock tab 112. Due to the closed position biasing of over-center spring 120, movable ring segments 32 may not automatically rotate into an opened position; however, once lock detent 100 is not longer vertically over lock tab 112, the binder mechanism may be considered to be in an unlocked state.

In this unlocked position, a user may manually open the binder mechanism by pulling movable ring segments 32 away from non-movable ring segments 34. Once a user exerts enough force on movable ring segments 32 to overcome the over-center spring bias (e.g., rotates rotating holder 110 and over-center spring protrusion 114 just enough so that apex-like structure 114 may come even with center 122 (zero-bias position); which will be explained further below), movable ring segments 32 will be pushed open by an opened position bias of over-center spring 120. Although in the depicted embodiments, the unlocked state is maintained by the user maintaining the semi-depressed state of the button, it should be appreciated that the binder mechanism may include any arrangement and/or be configured to retain the binder mechanism in the unlocked state upon releasing the button, as the present invention is not limited in this respect.

As button 70 is depressed past the unlocked position, wherein lock tab 112 is clear of lock detent 100, lock tab 112 may encounter ramp 102. As slide lock 90 is moved further along direction B, ramp 102 may push lock tab 112 upwards. Because lock tab 112 may be in a fixed relationship with rotating holder 110 and rotating holder may be in a fixed relationship with protrusion 114, as lock tab 112 is moved upwards, protrusion 114 is moved upwards as well. As may be seen in the embodiment of FIGS. 10 and 11, as protrusion 114 is rotated upwards, apex-like structure 115 moves toward center 122 of spring 120. Until apex-like structure 115 is even with center 122 (i.e. on-center), over-center spring 120 exerts a closed position bias on protrusion 114, wherein face 130 pushes downwards on surface 117. As mentioned above, when apex-like structure 115 comes even with center 122, over-center spring 120 may be in a zero-bias position, wherein over-center spring 120 may not be biasing movable ring segments 32 into an opened or a closed position.

As the ramp 102 continues to urge lock tab 112 upward, apex-like structure 115 moves above center 122, and the opened position bias of over-center spring 120 pushes protrusion 114 upwards. In particular, face 128 pushes against surface 116 to snap protrusion 114 and movable ring segments 32 into an opened position, as may be seen in the embodiment depicted in FIG. 10. It should be appreciated that lock tab 112 may not need to travel to the top of ramp 102 and that a user may depress button 70 only enough so that lock tab 112 is high enough on ramp 102, so that apex-like structure 115 of protrusion 114 may be high enough to be above center 122 of over-center spring 120. A user may know that he/she has depressed button 70 enough, because as soon as apex-like structure 115 is above center 122, the opened position bias of over-center spring 120 will push movable ring segments 32 into their opened position, which the user may visually, audibly and/or tactilely detect.

When a user removes a depressing force from button 70, the spring bias acting on slide lock 90 moves slide tab 92 in direction A, which exerts a force in direction A on cam slide lock portion 86 causing cam 80 to pivot about cam pivot 84. Cam button portion 82 then exerts a downwards force on connection arm 76, causing button 70 to pivot about button pivot 74. User interface 72 moves upwards. As may be seen in FIG. 7, slide lock 90 does not entirely return to its closed and locked position, because as slide lock 90 is being biased in direction A, opening surface 104 of lock detent 100 contacts lock tab 112. Surface 104 retains slide lock 90 in its unlocked position, such that when movable ring segments 32 are rotated closed, lock tab 112 moves downwards towards ramp 102 without striking lock detent 100.

To close the binder mechanism, the user pushes on movable ring segments 32 just enough to overcome the opening bias of over-center spring 120. In particular, as soon as a user pushes apex-like structure 115 just below center 122, the closing bias of over-center spring 120 may take over and face 130 pushes downwards on surface 117 to snap close the movable ring segments 32. As top surface 113 of lock tab 112 passes just below the bottom edge of opening surface 104, spring 94 biases slide lock 90 further along direction A and cavity 98 may surround lock tab 112, such that lock detent 100 resides again on top of lock tab 112, as depicted in FIG. 6.

It should be appreciated that any suitable materials, such as metals, plastics, rubbers, woods, foams, or any other material, may be used in forming one or more of the components of the binder mechanism, as will be apparent to one of skill in the art, as the present invention is not intended to be limited in this respect. Further, some components may be made from one material while other components may be made from another material or one component may be made from more than one material, as described above with respect to cover 50, as the present invention is not intended to be limiting in this respect. Further, button 70 may be made from sheet metal and covered and/or co-molded with a rubber or plastic material, such as TPE to create a softer or more cushioned feel and/or more grip for the user. Button 70 may also be formed with a hole through which a rubber or plastic or other suitable cushioning and/or gripping material may be inserted. In another example, the entire binder mechanism may be made from sheet metal to improve durability and reduce cost; however, to dampen any noise that the ring segments may make when they close together, rubber or plastic may be applied at suitable locations, such as at the ends of the ring segments. Further, to limit papers from being caught on the dampening material (e.g., rubber or plastic) of the rings, the dampening material may be centrally located on the surfaces of the ends of the rings surrounded by metal, so that the papers may only contact the smooth metal.

Figure 12:
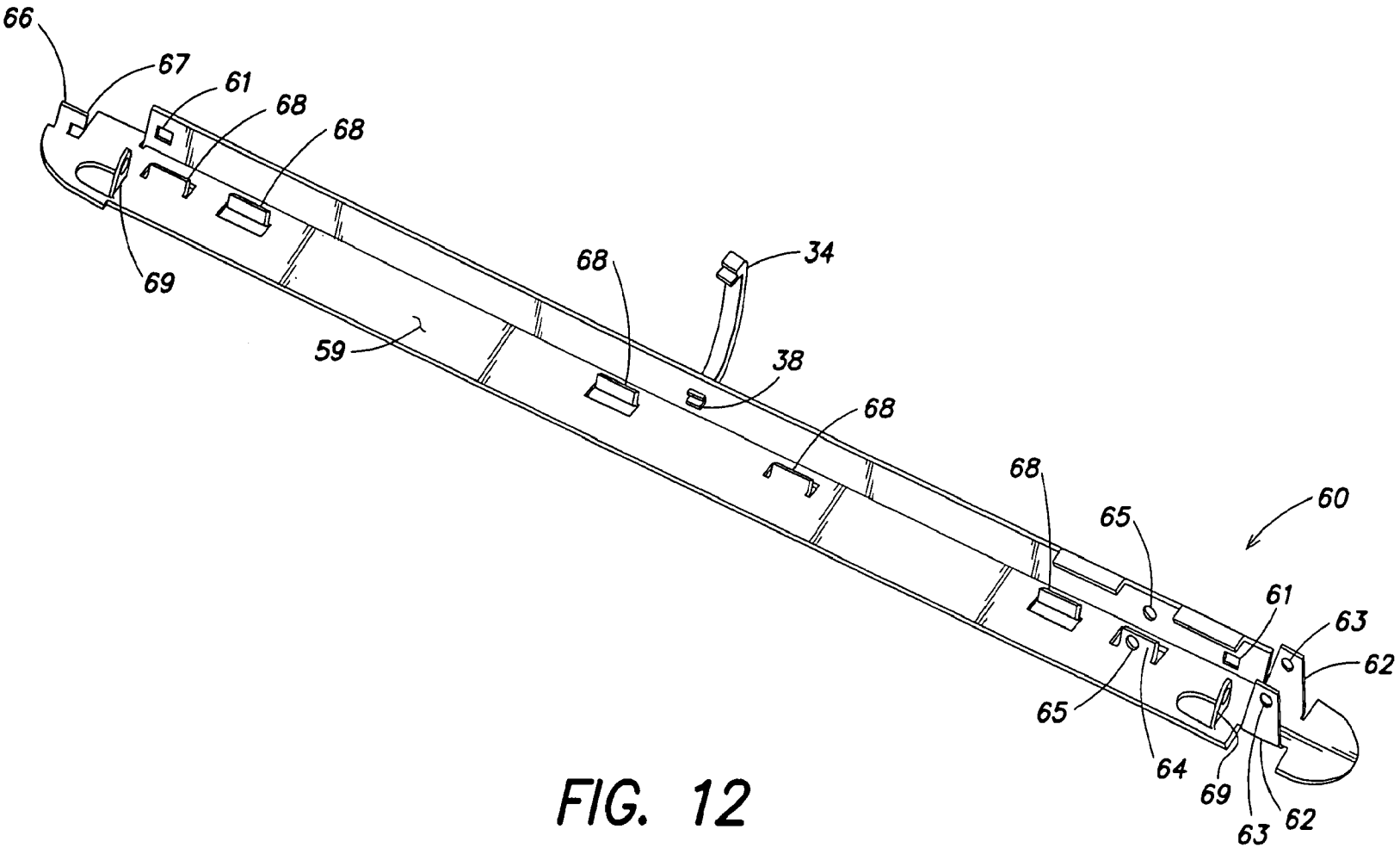
FIG. 12 is a perspective view of an illustrative embodiment of a base and a non-movable ring segment.

In addition or alternatively, certain portions of the binder mechanism may be optimally designed for different types of manufacture, as the present invention is not intended to be limited in this respect. For example, slide lock 90, as shown in the embodiments of FIGS. 5 and 6, may have components configured so that then entire element may be made from one piece of metal. In particular, slide tab 92 may be made by creating a slit in the sheet metal and then bending the portion of metal above the slit 90 degrees to create a right angle. As an additional example, base 60, as shown in the embodiment of FIG. 12, may include components, such as slide lock guides 68, rotating holder portion 69 and button pivot portions 62 which may be created by cutting out three sides of these elements and bending the element 90 degrees about the fourth side, so that a major surface of the elements may be positioned at a 90 degree angle to a major surface of base 60. Of course, other suitable manufacturing techniques may be employed, as the present invention is not limited in this respect.

Although the figures depict embodiments wherein certain elements are located in certain relative locations along the binder mechanism, it should be appreciated that any element may be located anywhere along the binder mechanism, as the present invention is not intended to be limited in this respect. For example, the button need not be located at one end of the binder mechanism and may be located in the middle of the binder mechanism.

In addition or alternatively, although the figures depict embodiments with certain numbers of each element (e.g., three locking structures, one button, three rings, one over-center spring), it should be appreciated that the binder mechanism may have any number of each element, as the present invention is not intended to be limited in this respect. For example, the binder mechanism may have one, two, three, four, five or more rings. In another embodiment, each movable ring segment may be controlled by its own opening locking arrangement or alternatively, a binder mechanism may include only one opening/locking arrangement for all of the rings.

Although the figures depict embodiments wherein only one of the two ring segments may move, it should be appreciated that the present invention is not limited in this respect as both segments of the rings may move relative to one another and relative to another fixed object, such as the base or the cover. In some embodiments, rings may include only one ring segment which may form a loop with the cover or another part of the binder mechanism, as opposed to a second ring segment.

It should be appreciated that various combinations of the above-described embodiments can be employed together, but several aspects of the invention are not limited in this respect. Therefore, although the specific embodiments disclosed in the figures and described in detail employ particular combinations of features, it should be appreciated that the present invention is not limited in this respect, as the various aspects of the present invention can be employed separately, or in different combinations. Thus, the particular embodiments described in detail are provided for illustrative purposes only.

It should also be appreciated that a variety of features employed in the art of binders may be used in combination with or to modify the above-described features and embodiments.

The foregoing written specification is to be considered to be sufficient to enable one skilled in the art to practice the invention. While the best mode for carrying out the invention has been described in detail, those skilled in the art to which this invention relates will recognize various alternative embodiments including those mentioned above as defined by the following claims. The examples disclosed herein are not to be construed as limiting of the invention as they are intended merely as illustrative of particular embodiments of the invention as enabled herein. Therefore, systems and methods that are functionally equivalent to those described herein are within the spirit and scope of the claims appended hereto. Indeed, various modifications of the invention in addition to those shown and described herein will become apparent to those skilled in the art from the foregoing description and fall within the scope of the appended claims.

What is claimed is:

1. A binder mechanism for binding articles, the binder mechanism comprising:

a base;

an elongate ring support rotatably mounted to the base, the elongate ring support comprising a plurality of ring members adapted to receive the article, the elongate ring support having an open configuration and a closed configuration;

a locking arrangement comprising:

a locking tab disposed on the elongate ring support;

an elongate slide lock slidably mounted relative to the base, the slide lock having a lock structure comprising: a lock detent defining a cavity thereunder constructed and arranged to receive the locking tab when the slide lock is in a first position so that the locking tab is held in the cavity by the lock detent and the elongate ring support is held in the closed configuration; and an opening disposed adjacent the cavity constructed and arranged to cooperate with the locking tab such that, when the slide lock is moved to a second position and the locking tab is freed from the cavity, the locking tab can move into the opening to allow the elongate ring support to rotate toward the open configuration; and a spring disposed between the slide lock and the base, the spring biasing the slide lock toward the first position;

an opening mechanism cooperating with the slide lock and constructed and arranged to move the slide lock to the second position, the opening mechanism comprising a button and a lever arm pivotally mounted to the base in a manner whereby downward motion of the button results in upward motion of the lever arm; and a cam rotatably mounted to the base and cooperating between the lever arm and the slide lock such that upward movement of the lever arm causes the cain to rotate and push on the slide lock toward the second position.

2. The binder mechanism according to claim 1, wherein the button comprises a material adapted to increase at least one of gripping and cushioning of the button for a user.

3. The binder according to claim 1, wherein the button includes a contoured surface.

4. The binder mechanism according to claim 1, wherein the base is an elongate base and wherein the button is disposed at one end of the base.

5. The binder mechanism according to claim 1, wherein the base is an elongate base and includes a mounting surface, wherein the button comprises a generally horizontal surface that, when the button is mounted to the base and is in a rest position whereby the slide lock is in the first position, is generally parallel to the mounting surface of the base.

6. The binder mechanism according to claim 1, further comprising a cover constructed and arranged to cover at least a substantial portion of the base, the elongate ring support, and the locking arrangement, wherein the cover comprises a cutout adapted to receive the button, the button being substantially flush with the base and cover when the interface is in a rest position whereby the slide lock is in the first position.

7. The binder mechanism according to claim 1, wherein the slide lock comprises first, second and third lock structures and wherein elongate ring support comprises corresponding first, second and third locking tabs laterally extending from the elongate ring support, each lock structure comprising: the lock detent defining the cavity thereunder constructed and arranged to receive the corresponding locking tab when the slide lock is in the first position so that the corresponding locking tab is held in the cavity by the lock detent and the elongate ring support is held in the closed configuration; and the opening disposed adjacent the cavity constructed and arranged to cooperate with the corresponding locking tab such that, when the slide lock is moved to a second position and each locking tab is freed from the corresponding cavity, each locking tab can move into each opening to allow the elongate ring support to rotate toward the open configuration.

8. The binder mechanism according to claim 7, wherein each lock structure further comprises a ramp disposed adjacent the cavity constructed and arranged to cooperate with the locking tab such that, when the slide lock is moved to a second position and the locking tab is freed from the cavity, the locking tab is urged by the ramp to rotate the elongate ring support toward the open configuration.

9. The binder mechanism according to claim 8, further comprising an over-center spring and lever arrangement cooperating between the base and the elongate ring support and constructed and arranged to bias the elongate ring support toward a closed direction when the elongate ring support is at least partially in the closed configuration and to bias the elongate ring support toward an open direction when the elongate ring support is at least partially in the open configuration.

10. The binder mechanism according to claim 1, wherein the locking tab laterally extends perpendicular to elongate ring support and the elongate slide lock.

11. The binder mechanism according to claim 1, wherein the lock detent includes a surface that is constructed and arranged to abut the locking tab when the slide lock is in the second position and the elongate ring support is in the open configuration.

12. The binder mechanism according to claim 1, further comprising a cover constructed and arranged to cover at least a substantial portion of the base, the elongate ring support, and the locking arrangement, wherein the cover is one of transparent and translucent.

13. The binder mechanism according to claim 1, wherein the base comprises a plurality of fixed ring members corresponding to and cooperating with the plurality of ring members of the elongate ring support.

14. The binder mechanism according to claim 1, in combination with a binder.

15. The binder mechanism according to claim 1, further comprising an over-center spring and lever arrangement cooperating between the base and the elongate ring support and constructed and arranged to bias the elongate ring support toward a closed direction when the elongate ring support is at least partially in the closed configuration and to bias the elongate ring support toward an open direction wh&n the elongate ring support is at least partially in the open configuration.

16. The binder mechanism according to claim 15, wherein the over-center spring arrangement comprises a protrusion disposed on the elongate ring support and a leaf spring disposed on the base, wherein the protrusion comprises first and second surfaces and an apex therebetween and wherein the leaf spring comprises corresponding first and second faces and a center therebetween, wherein the first face of the leaf spring biases the first surface of the protrusion toward the closed direction such that the elongate ring support is held in the closed configuration when in the closed configuration and wherein the second face of the leaf spring biases the second surface of the protrusion toward the open direction such that the elongate ring support is held in the open configuration when in the open configuration.

17. The binder mechanism according to claim 16, wherein the lock structure further comprises: a ramp disposed adjacent the cavity constructed and arranged to cooperate with the locking tab such that, when the slide lock is moved to a second position and the locking tab is freed from the cavity, the locking tab is urged by the ramp to rotate the elongate ring support toward the open configuration.

18. The binder mechanism according to claim 15, wherein the lock structure further comprises: a ramp disposed adjacent the cavity constructed and arranged to cooperate with the locking tab such that, when the slide lock is moved to a second position and the locking tab is freed from the cavity, the locking tab is urged by the ramp to rotate the elongate ring support toward the open configuration.

19. The binder mechanism according to claim 1, wherein the lock structure further comprises: a ramp disposed adjacent the cavity constructed and arranged to cooperate with the locking tab such that, when the slide lock is moved to a second position and the locking tab is freed from the cavity, the locking tab is urged by the ramp to rotate the elongate ring support toward the open configuration.

* * * * *